US008362990B2

(12) United States Patent
Ohashi et al.

(10) Patent No.: US 8,362,990 B2
(45) Date of Patent: Jan. 29, 2013

(54) VIDEO SIGNAL PROCESSING CIRCUIT, DISPLAY APPARATUS, LIQUID CRYSTAL DISPLAY APPARATUS, PROJECTION TYPE DISPLAY APPARATUS AND VIDEO SIGNAL PROCESSING METHOD

(75) Inventors: Naoki Ohashi, Kanagawa (JP); Takashi Hirakawa, Tokyo (JP)

(73) Assignee: Sony Corporation, Tokyo (JP)

( * ) Notice: Subject to any disclaimer, the term of this patent is extended or adjusted under 35 U.S.C. 154(b) by 992 days.

(21) Appl. No.: 12/382,317

(22) Filed: Mar. 13, 2009

(65) Prior Publication Data

US 2009/0243983 A1 Oct. 1, 2009

(30) Foreign Application Priority Data

Mar. 27, 2008 (JP) ..... 2008-084812

(51) Int. Cl.
*G09G 3/36* (2006.01)

(52) U.S. Cl. ..... 345/87; 345/89; 345/98; 345/100; 345/204; 345/690

(58) Field of Classification Search ..... 345/87, 345/89, 690, 204–215
See application file for complete search history.

(56) References Cited

U.S. PATENT DOCUMENTS

| | | | | |
|---|---|---|---|---|
| 6,501,451 | B1 * | 12/2002 | Sakashita | 345/87 |
| 6,943,763 | B2 * | 9/2005 | Shibata et al. | 345/89 |
| 2003/0156121 | A1 * | 8/2003 | Willis | 345/606 |
| 2008/0018630 | A1 * | 1/2008 | Fujino | 345/205 |

FOREIGN PATENT DOCUMENTS

| | | |
|---|---|---|
| JP | 2001-059957 | 3/2001 |
| JP | 2008-046613 A | 2/2008 |

OTHER PUBLICATIONS

Japanese Office Action issued Jan. 26, 2010 for corresponding Japanese Application No. 2008-084812.

* cited by examiner

*Primary Examiner* — Quan-Zhen Wang
*Assistant Examiner* — Jennifer Nguyen
(74) *Attorney, Agent, or Firm* — Rader, Fishman & Grauer PLLC

(57) ABSTRACT

A video signal processing circuit is disclosed. The video signal processing circuit includes a difference detection section, first calculation section, and correction amount addition section. The difference detection section detects a difference between a drive voltage for each of pixels of a matrix drive type display panel as a pixel under consideration and a drive voltage of each of pixels adjacent to the pixel under consideration from an input video signal. The first calculation section calculates a correction amount of a drive voltage for a pixel under correction that has a luminance change due to an electric field caused by a difference of the drive voltages for the two pixels detected by the difference detection section. The correction amount addition section corrects a value of the drive voltage for a pixel under correction that has the luminance change based on the correction amount calculated by the first calculation section.

13 Claims, 18 Drawing Sheets

VIDEO SIGNAL PROCESSING CIRCUIT, DISPLAY APPARATUS, LIQUID CRYSTAL DISPLAY APPARATUS, PROJECTION TYPE DISPLAY APPARATUS AND VIDEO SIGNAL PROCESSING METHOD

BACKGROUND OF THE INVENTION

1. Field of the Invention

The present invention relates to a video signal processing circuit, a display apparatus, a liquid crystal display, a projection type display apparatus, and a video signal processing method suitable for improving image quality defects caused by a lateral electric field that occurs in a matrix drive type display panel, for example, a liquid crystal display apparatus or the like.

2. Description of the Related Art

A so-called lateral electric field occurs at a signal boundary region (namely between electrodes of two adjacent pixels) where a potential difference occurs in a video signal supplied to individual pixels in a matrix drive type display apparatus. This lateral electric field disturbs electric fields applied to electrodes of individual pixels, resulting in occurrence of image quality defects. The image quality defects cause shading because of a voltage difference between a drive voltage supplied to a pixel under consideration and that supplied to each of adjacent pixels corresponding to a video signal. FIG. 1A, FIG. 1B, and FIG. 1C show examples in which image quality defects occur.

FIG. 1A shows an example of a display image 1 corresponding to an input video signal and an example of a display image 1A where an image quality defect occurs both on a display apparatus having, for example, 7 (vertical)×7 (horizontal) pixels. 3×5 pixels at a center portion of the display image 1 corresponding to the input video signal have a black level as their luminance and pixels adjacent thereto have a gray level as their luminance. In contrast, pixels 2*a* to 2*c* and pixels 2*d* to 2*h* that are formed adjacent to the left and below, respectively, of the 3×5 pixels at the center portion of the display image 1A where the image defect occurs have a white-blurring display pattern.

FIG. 1B shows an example of a display image 11 corresponding to an input video signal and an example of a display image 11A where an image defect occurs in a display apparatus having, for example, 7 (vertical)×7 (horizontal) pixels. Likewise, 3×5 pixels at a center portion of the display image 11 corresponding to the input video signal have a black level as their luminance and pixels adjacent thereto have a white level as their luminance. In contrast, pixels 12*a* to 12*e* and pixels 12*f* to 12*h* that are formed adjacent to the above and the right, respectively, of the 3×5 pixels at the center portion of the display image 11A where an image quality defect occurs have a black-blurring display pattern.

FIG. 1C shows an example of a display image 21 corresponding to an input video signal and an example of a display image 21A where an image quality defect occurs on a display apparatus having, for example, 7 (vertical)×7 (horizontal) pixels. 3×5 pixels at a center portion of the display image 21 corresponding to the input video signal have a gray level as their luminance and pixels adjacent thereto have a white level as their luminance. In contrast, pixels 22*a* to 22*g* that are formed adjacent to the above and the right, respectively, of the 3×5 pixels at the center portion of the display image 21A have a black-mixed display pattern.

FIG. 2A and FIG. 2B are schematic diagrams showing a theory of occurrence of an image quality defect phenomenon in a liquid crystal display apparatus. FIG. 2A shows microscopic photos of adjacent pixels 31 and 32. FIG. 2B shows alignments of liquid crystal molecules of the pixels 31 and 32. A lateral electric field 33 occurs between the pixels 31 and 32. The lateral electric field 33 causes the alignments of liquid crystal molecules 34*a* and 35*a* that leftward tilt to be disturbed as those of liquid crystal molecules 34*b* and 35*b*, respectively. In addition, the lateral electric field 33 causes liquid crystal molecules 34*c* and 35*c* that are present in the vicinity of the boundary of the pixel 31 and pixel 32 to be aligned perpendicularly to the lateral electric field 33. Since molecules aligned in parallel or perpendicular to the axis of a polarizing plate occur like the liquid crystal molecule 34*c* and liquid crystal molecule 35*c* in the pixels 31 and 32, their transmittances change, resulting in occurrence of black lines 36 and 37. According to such a theory, in the liquid crystal display apparatus, the lateral electric field causes the alignment directions of liquid crystal molecules to rotate and the disturbance of the alignment directions causes a domain-caused image quality defect. When one pixel is composed of three sub-pixels of three primary colors R (Red), G (Green), and B (Blue), a lateral electric field occurs between two sub-pixels of the these primary colors.

Next, with reference to FIG. 3A and FIG. 3B, an outlined structure of a liquid crystal display apparatus will be described. FIG. 3A is an exploded perspective view of a liquid crystal display apparatus. FIG. 3B is an enlarged view of a principal portion of FIG. 3A. As shown in FIG. 3A and FIG. 3B, a liquid crystal display apparatus 40 includes a liquid crystal layer 41, an upper glass substrate 42, a lower glass substrate 44, and polarizing plates 46 and 47. The upper glass substrate 42 and the lower glass substrate 44 are aligned with the liquid crystal layer 41. The polarizing plates 46 and 47 are aligned with the upper glass substrate 42 and the lower glass substrate 44, respectively.

As shown in FIG. 3A and FIG. 3B, a transparent electroconductive film 43 is formed on the upper glass substrate 42. A common electrode that is common in the entire pixel pattern is formed on the upper glass substrate 42. In addition, as shown in FIG. 3A and FIG. 3B, formed on the lower glass substrate 44 are pixel electrodes (pixel patterns) $\mathbf{48}_n$ and $\mathbf{48}_{n+1}$ and thin film transistors (TFTs) $\mathbf{49}_n$ and $\mathbf{49}_{n+1}$ that are switch devices that drive the pixel electrodes (pixel patterns) corresponding to pixels. Moreover, formed on the lower glass substrate 44 are patterns of X electrodes (scanning lines) $X_n$ and $X_{n+1}$ that are gate inputs of the thin film transistors $\mathbf{49}_n$, $\mathbf{49}_{n+1}$ and Y electrodes (signal wires) $Y_n$ and $Y_{n+1}$ that are source inputs thereof. The polarizing plates 46 and 47 are disposed such that axes 46*a* and 47*b* of the polarizing plates 46 and 47 are perpendicular thereto.

In such a structure, only liquid crystal molecules 41*a* and 41*b* in an area sandwiched by a pixel electrode and a common electrode in the liquid crystal layer 41 are affected by an electric field between the pixel electrode and the common electrode and thereby the their alignments are changed, resulting in functioning as a liquid crystal shutter of one pixel. A lateral electric field occurs between Y electrodes or pixels electrodes of two adjacent pixels due to a potential difference of a video signal supplied to the two adjacent pixels.

Liquid crystal display apparatus are mainly categorized as a perfect vertical alignment type and a tilt alignment type. The perfect vertical alignment type is referred to as so-called VA (Vertical Alignment). In this type, liquid crystal molecules in the liquid crystal layer are aligned perpendicularly to the substrate with an alignment film (not shown) in the state that no voltage is applied to an electrode corresponding to a pixel. In other words, tilt angles θ of the liquid crystal molecules 41*a* and 41*b* to the substrate are 90 degrees. If a voltage is applied to an electrode corresponding to the pixel, since the direction in which liquid crystal molecules tilt (alignment direction) is free, the alignment directions of the liquid crystal molecules are not matched.

On the other hand, in the tilt alignment type, an alignment film (not shown) causes liquid crystal molecules of the liquid crystal layer to be aligned such that they tilt in the normal direction of a substrate in the state that no voltage is applied to an electrode corresponding to a pixel and the liquid crystal molecules to be aligned such that they are aligned nearly level with the substrate in the state that a voltage is applied. In other words, as shown in FIG. 3B, pre-tilt angles θ of the liquid crystal molecules 41*a* and 41*b* against the substrate are smaller than 90 degrees. When the pre-tilt angles are present in the liquid crystal molecules 41*a* and 41*b*, if the liquid crystal display apparatus 40 is viewed from the front (in the direction normal to the substrate), the liquid crystal molecules 41*a* and 41*b* tilt in a predetermined direction. When a voltage is applied to an electrode corresponding to a pixel in this state, the directions in which the liquid crystal molecules 34*a* and 35*b* shown in FIG. 2B tilt depend on the pre-tilt angles. Since the alignment directions of liquid crystal molecules are decided in one direction, light that transmits through the pixels becomes uniform and thereby the liquid crystal display apparatus displays an image in high quality.

In a liquid crystal display apparatus having such a pre-tilt angle, the direction in which the image quality defect phenomenon occurs also depends on the evaporation direction of liquid crystal molecules. FIG. 4A, FIG. 4B, FIG. 4C show examples of display images corresponding to input video signals in a VA, right-evaporated liquid crystal display apparatus and those where image quality defects occur therein.

FIG. 4A shows an example of a display image 51 of one line (seven pixels) corresponding to an input video signal and an example of a display image 51A where an image quality defect occurs. Three pixels at a center portion of the display image 51 corresponding to the input video signal have a black level as their luminance and pixels adjacent thereto have a gray level as their luminance. In contrast, a pixel 51*a* that is formed adjacent to the left of the three pixels at the center portion in the display image 51A where an image quality defect occurs has a white-blurring display pattern.

FIG. 4B shows an example of a display image 52 of one line (seven pixels) corresponding to an input video signal and an example of a display image 52A where an image quality defect occurs. Three pixels at a center portion of the display image 52 corresponding to the input video signal have a black level as their luminance and pixels adjacent thereto have a white level as their luminance. In contrast, a pixel 52*a* that is formed adjacent to the right of the three pixels at the center portion in the display image 52A where the image quality defect occurs has a black-blurring display pattern.

FIG. 4C shows an example of a display image 53 of one line (seven pixels) corresponding to an input video signal and an example of a display image where an image quality defect occurs. Three pixels at a center portion of the display image 53 corresponding to the input video signal have a white level as their luminance and pixels adjacent thereto have a white level as their luminance. In contrast, a pixel 53 formed adjacent to a pixel having a white level on the right of the three pixels at the center portion in the display image 53A where the image quality defect occurs has a black-blurring display pattern.

In contrast, in a left-evaporated liquid crystal display apparatus, the image quality defect phenomenon occurs in a direction opposite to that of the right-evaporated liquid crystal display apparatus shown in FIG. 4A and FIG. 4B. For example, in the display image 51 corresponding to the input video signal shown in FIG. 4A, if the liquid crystal display apparatus is of the left-evaporated type, a pixel 51*b* that is formed adjacent to the right of the three pixels at the center portion in the image 51A where the image quality defect occurs has a white-blurring display pattern. Thus, although the causes of occurrence of the image quality defects are the same, they differently appear.

In addition, liquid crystal display apparatus have a voltage-transmittance (V-T) characteristic where the transmittance of the liquid crystal layer changes with a voltage applied to a pixel electrode. In color liquid crystal display apparatus, since the VT characteristic differs in each of R (red), G (green), and B (blue), shading of the image quality defective phenomenon differs in RGB.

Although the foregoing liquid crystal display apparatus are of the VA type, twisted nematic (TN) type liquid crystal display apparatus are affected by a lateral electric field. However, since their normally white (NW) and normally black (NB) are different, they differently appear. FIG. 5A and FIG. 5B show display patterns that differ in these types of liquid crystal display apparatus.

FIG. 5A shows an example of a display image 61 composed of 7 (vertical)×7 (horizontal) pixels where an image quality defect occurs in a TN type liquid crystal display apparatus (NW). In a display image corresponding to an original input video signal, 3×5 pixels at a center portion have a black level as their luminance and pixels adjacent thereto have a white level as their luminance. In contrast, in a display image 61 where the image quality defect occurs, pixels 61*a* to 61*g* that are formed as five upper pixels and three right pixels of the 3 ×5 pixels at the center portion have a white blurring display pattern.

On the other hand, FIG. 5B shows an example of a display image 62 of 7 (vertical)×7 (horizontal) pixels where an image quality defect occurs in a VA type liquid crystal display apparatus (NB). In the display image 62 where the image quality defect occurs corresponding to the same input video signal as that shown in FIG. 5A, pixels 62*a* to 62*e* that are formed adjacent to the above of 3×5 pixels at the center portion and pixels 62*f* to 62*h* that are formed adjacent to the right of the 3 ×5 pixels have a black-blurring display pattern.

In the foregoing, the image quality defect phenomenon that occurs, for example, in liquid crystal display apparatus, due to the influence of a horizontal electric field has been described. However, the image quality defect phenomenon due to an influence of a lateral electric field also occurs other than liquid crystal display apparatus. In other words, a similar image quality defect phenomenon occurs in display apparatus where pixels are arranged in a matrix shape on a display panel and voltages are applied to a scanning line and a signal wire of a pixel under consideration such that the pixel under consideration is lit. For example, in organic electroluminescence (EL) display apparatus, a lateral electric field causes the motions of electrons and positive holes in pixels to disturb, resulting in occurrence of an image quality defect. Moreover, in plasma display apparatus, a lateral electric field affects generation of plasma in pixels, resulting in occurrence of an image quality defect.

However, so far, in matrix drive type display apparatus, image quality defects affected by a lateral electric field that occurs between two pixels due to a potential difference of a video signal supplied to individual pixels has been improved. For example, Japanese Unexamined Patent Application Publication No. 2001-59957, referred to as Patent Document 1, discloses a technique that scans pixels at a period shorter than a frame period in synchronization therewith and applies a signal that has been modulated with a pulse width to signal wires. This technique allows liquid crystal to be driven by frame inversion free of flickering and declination.

SUMMARY OF THE INVENTION

However, in the technique described in Patent Document 1, when a video signal that causes a voltage difference to occur between two adjacent pixels is applied in the same frame period, a problem that a lateral electric field that occurs between pixels (lines) causes liquid crystal molecules to be improperly aligned is not solved. In addition, Patent Document 1 does not propose a solution against disturbance of alignment of liquid crystal molecules due to a voltage difference between adjacent pixels (in the horizontal direction) and between adjacent lines (in the vertical direction).

In view of the foregoing, it would be desirable to provide a technique that applies a correction voltage only to a pixel where an image quality defect occurs due to a lateral electric field in a matrix drive type display apparatus so as to solve the image quality defect.

According to an embodiment of the present invention, there is provided a video signal processing circuit. The video signal processing circuit includes a difference detection section, a first calculation section, and a correction amount addition section. The difference detection section detects a difference between a drive voltage for each of pixels of a matrix drive type display panel as a pixel under consideration and a drive voltage of each of pixels adjacent to the pixel under consideration from an input video signal. The first calculation section calculates a correction amount of a drive voltage for a pixel under correction that has a luminance change due to an electric field caused by a difference of the drive voltages for the two pixels detected by the difference detection section.

The correction amount addition section corrects a value of the drive voltage for a pixel under correction that has the luminance change based on the correction amount calculated by the first calculation section.

According to an embodiment of the present invention, there is provided a display apparatus. The display apparatus includes a matrix drive type display panel, a video signal processing circuit, and a drive circuit. The video signal processing circuit includes a difference detection section, a first calculation section, and a correction amount addition section. The difference detecting section detects a difference between a drive voltage for each of pixels of the matrix drive type display panel as a pixel under consideration and a drive voltage of each of pixels adjacent to the pixel under consideration from an input video signal. The first calculation section calculates a correction amount of a drive voltage for a pixel under correction that has a luminance change due to an electric field caused by a difference of the drive voltages for the two pixels detected by the difference detection section. The correction amount addition section corrects a value of the drive voltage for a pixel under correction that has the luminance change based on the correction amount calculated by the first calculation section. The drive circuit supplies a drive voltage output from the correction amount addition section to each pixel of the display panel.

The display apparatus can be applied, for example, to a direct-view-type liquid crystal display apparatus that uses a matrix drive type liquid crystal panel.

In addition, the display apparatus can be applied, for example, to a projection type display apparatus that emits illumination light to a matrix drive type liquid crystal panel and projects transmission light to a screen.

According to a video signal processing circuit, a potential difference (difference of drive voltages) of a video signal that is input to two adjacent pixels on a display panel is detected. When there is a difference between the drive voltages for two adjacent pixels, a pixel to be corrected (pixel under correction) is selected based on the difference of the drive voltage of the two pixels. Thereafter, a correction amount of the drive voltage for the pixel under correction is calculated based on the difference of the drive voltage of the two pixels and the input video signal corresponding to the pixel under correction. The value of the drive voltage supplied to the pixel under correction is corrected based on the calculated correction amount. Since the voltage difference of the drive voltage for the two adjacent pixels is obtained, the drive voltage supplied to the pixel under correction is calculated based on the voltage difference. Thus, the voltage of the drive voltage can be corrected only for the pixel under correction that has a luminance change due to a lateral electric field.

In addition, since the value of the drive voltage is corrected only for the pixel under correction whose luminance changes and an image corresponding to the corrected video signal is displayed only the display panel. Thus, an excellent display image can be obtained.

According to an embodiment of the present invention, there is provided a video signal processing method. A difference is detected between a drive voltage for each of pixels of a matrix drive type display panel as a pixel under consideration and a drive voltage of each of pixels adjacent to the pixel under consideration from an input video signal. A correction amount of a drive voltage is calculated for a pixel under correction that has a luminance change due to an electric field caused by a difference of the drive voltages for the two pixels that have been detected. A value of the drive voltage for a pixel under correction that has the luminance change is corrected based on the correction amount that has been calculated.

According to a video signal processing-method, a potential difference (difference of drive voltages) of a video signal that is input to two adjacent pixels on a display panel is detected. When there is a difference between the drive voltages for two adjacent pixels, a pixel to be corrected (pixel under correction) is selected based on the difference of the drive voltage of the two pixels. Thereafter, a correction amount of the drive voltage for the pixel under correction is calculated based on the difference of the drive voltage of the two pixels and the input video signal corresponding to the pixel under correction. The value of the drive voltage supplied to the pixel under correction is corrected based on the calculated correction amount. Since the voltage difference of the drive voltage for the two adjacent pixels is obtained, the drive voltage supplied to the pixel under correction is calculated based on the voltage difference. Thus, the voltage of the drive voltage can be corrected only for the pixel under correction that has a luminance change due to a lateral electric field.

According to embodiments of the present invention, an image quality defect caused by a lateral electric field that occurs between adjacent pixels in a matrix drive type display apparatus can be improved by applying a correction voltage only to a pixel where such a phenomenon occurs.

BRIEF DESCRIPTION OF THE DRAWINGS

The invention will become more fully understood from the following detailed description, taken in conjunction with the accompanying drawings, wherein similar reference numerals denote corresponding elements, in which.

DETAILED DESCRIPTION OF THE PREFERRED EMBODIMENTS

Next, with reference to the accompanying drawings, embodiments of the present invention will be described.

Since embodiments that will be described in the following are preferred ones of the present invention, various technically preferably limitations are imposed thereto. However, it is appreciated that the scope of the present invention is not limited to these embodiments unless described that they impose limitations to the present invention. Thus, material types, their amounts, processing times, processing orders, numeric conditions of parameters described in the following embodiments are just preferred examples. In addition, dimensions, shapes, arrangements, and so forth in each drawing used to describe the embodiments are just examples.

Next, with reference to FIG. 6 to FIG. 14A to FIG. 14C, a first embodiment of the present invention will be described.

Figure 1A:
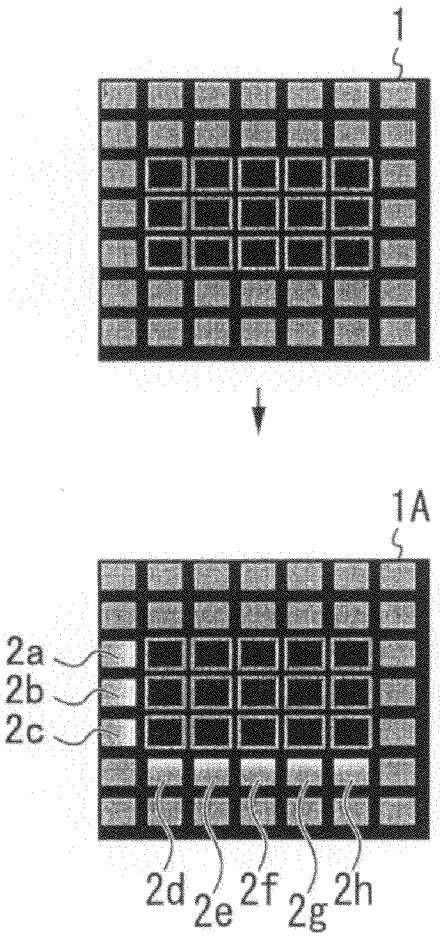
FIG. 1A, FIG. 1B, and FIG. 1C are schematic diagrams showing examples of image quality defect phenomena caused by a lateral electric field.
Figure 1B:
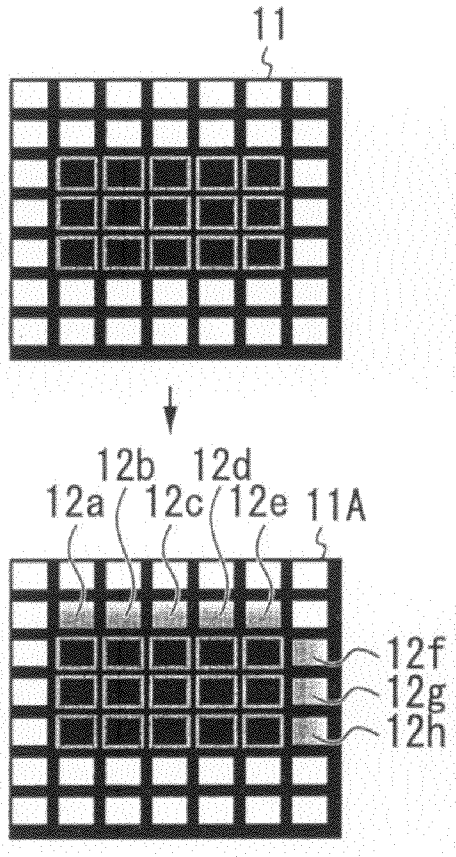
Figure 1C:
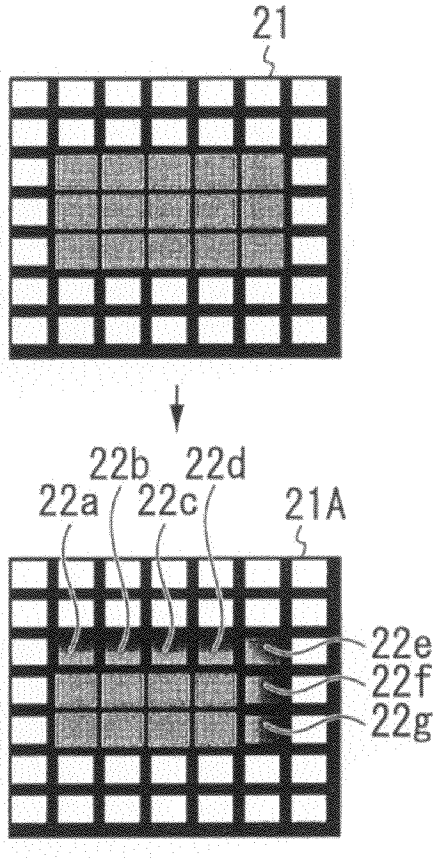
Figure 2A:
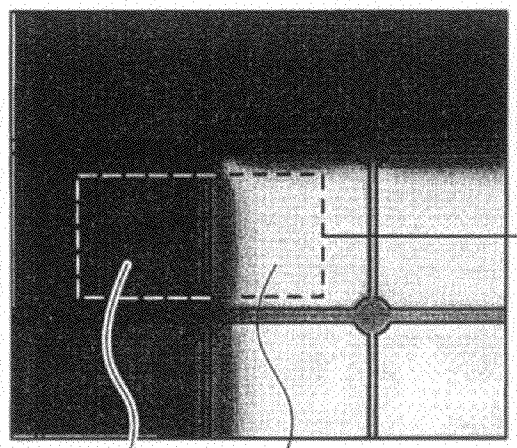
FIG. 2A and FIG. 2B are schematic diagrams showing a theory of occurrence of an image quality defect phenomenon.
Figure 2B:
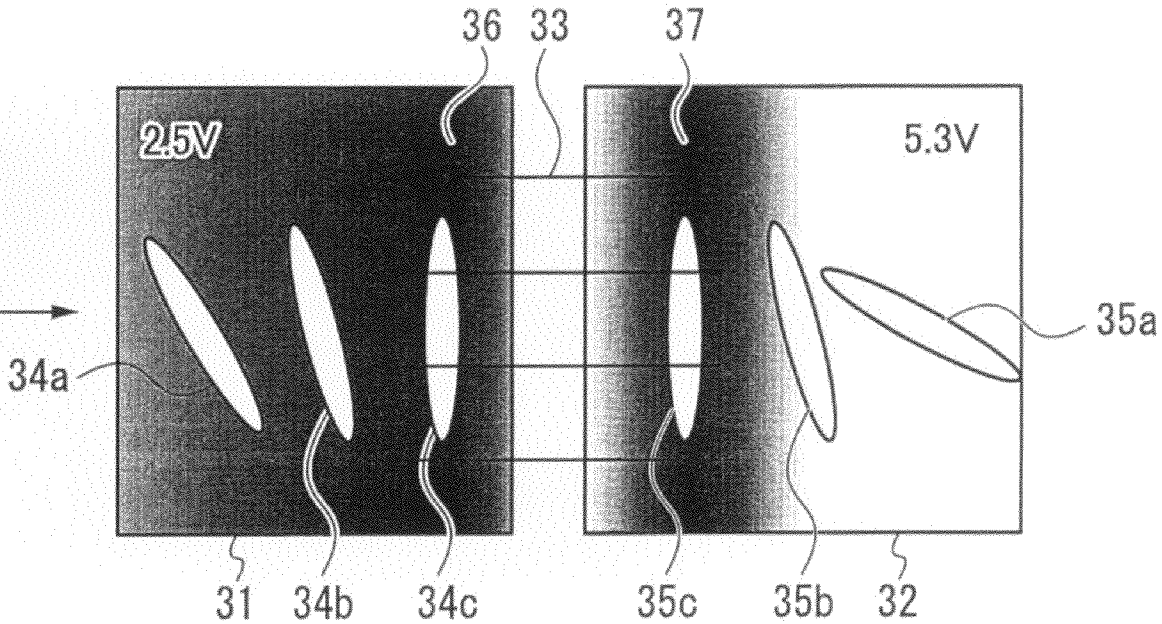
Figure 3A:
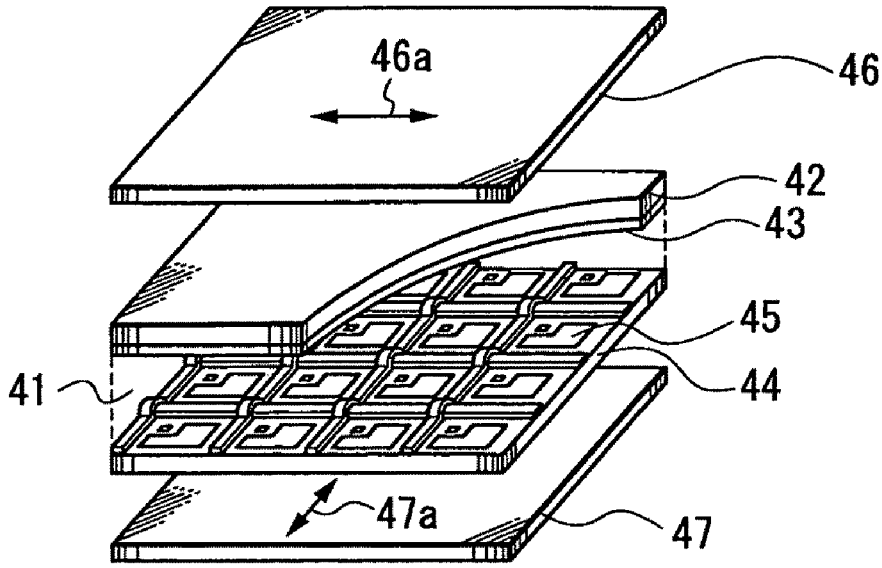
FIG. 3A and FIG. 3B are schematic diagrams showing an outlined structure of a liquid crystal display apparatus.
Figure 3B:
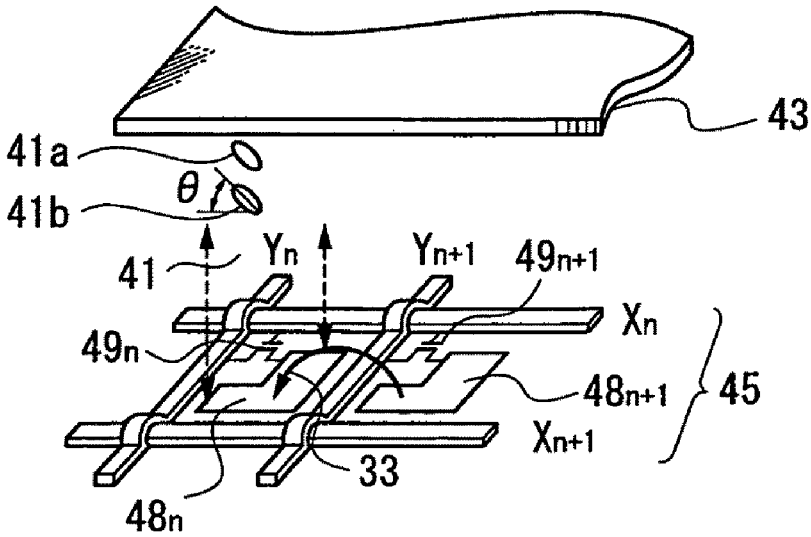
Figure 6:
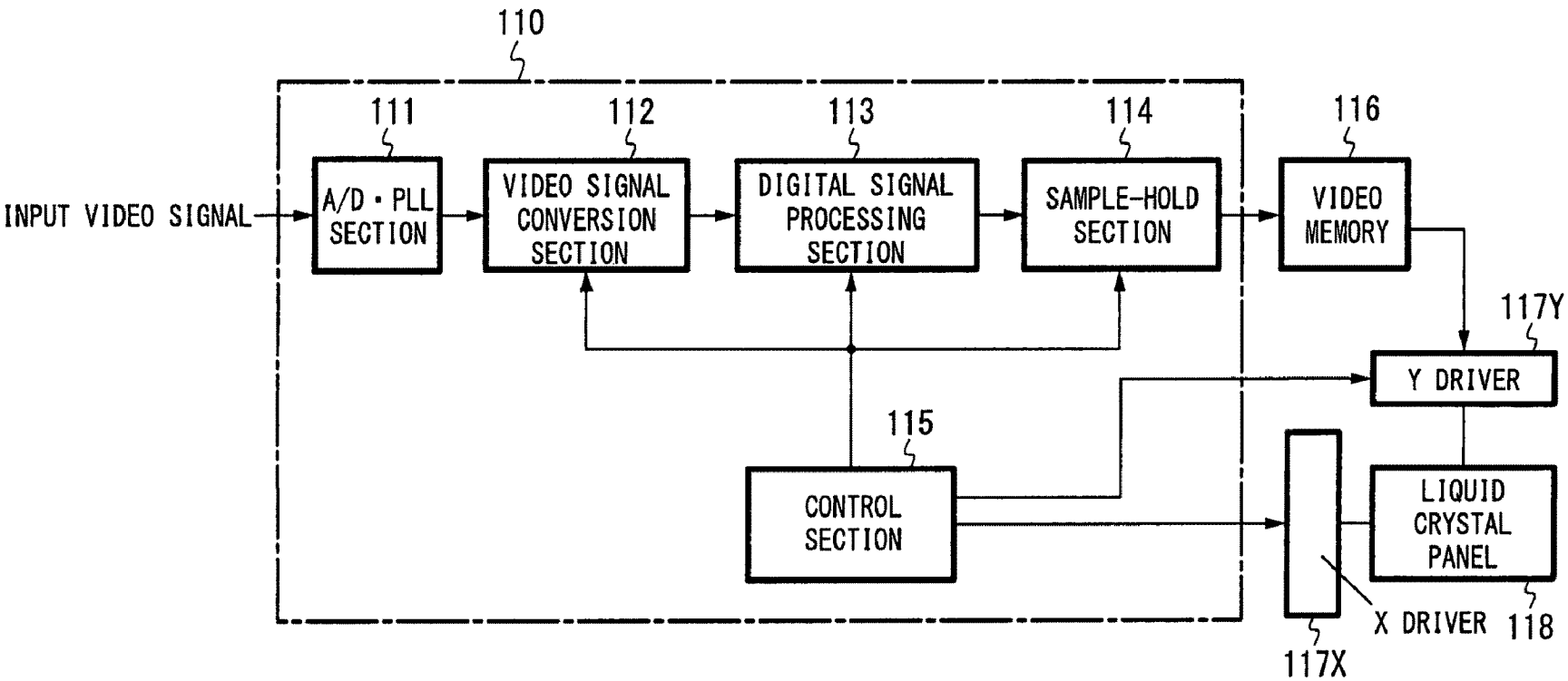
FIG. 6 is a block diagram showing an example of a structure of a liquid crystal display apparatus according to a first embodiment of the present invention.

FIG. 6 is a schematic diagram showing a structure of a liquid crystal display apparatus 100 according to a first embodiment of the present invention. The liquid crystal display apparatus 100 includes a video signal processing circuit 110, a video memory 116, an X driver circuit 117X, a Y driver circuit 117Y, and a liquid crystal panel 118. Although the liquid crystal display apparatus 100 may be structured as the liquid crystal display apparatus of the related art shown in FIG. 3, signal processes for an input video signal of the liquid crystal display apparatus 100 are different from those of the liquid crystal display apparatus of the related art.

The video signal processing circuit 110 processes an input video signal in a signal format suitable for the liquid crystal panel 118 and supplies the resultant signal to the video memory 116. The video signal processing circuit 110 includes an analog/digital phase-locked loop (A/D·PLL) section 111, a video signal conversion section 112, a digital signal processing section 113, a sample-hold section 114, and a control section 115.

The A/D·PLL section 111 is a device that converts an analog video signal into digital pixel data and accomplishes phase synchronization of the input video signal. When the input video signal is a digital signal, the video signal processing circuit 110 is provided with a digital interface instead of the A/D·PLL section 111. The digital interface section is a device that converts an input video signal into a digital format according to a data transmission technique such as the digital visual interface (DVI) system, high-definition multimedia interface (HDMI) system, or the like.

The video signal conversion section 112 is a device that converts pixel data that are output from the A/D·PLL section 111 into pixel data (primary color data) corresponding to the number of pixels and clock frequency of the liquid crystal panel 118. When the liquid crystal panel 118 is a color panel, the video signal conversion section 112 converts composite signals into RGB separate signals suitable for driving the color liquid crystal panel and outputs the RGB separate signals to the digital signal processing section 113 along with the video signal.

The digital signal processing section 113 performs contrast adjustment, crosstalk correction, and so forth for pixel data (primary color data), that are output from the video signal conversion section 112. The digital signal processing section 113 also performs a video signal process of this embodiment, namely corrects a drive voltage for a pixel under correction.

The sample-hold section 114 sample-holds pixel data (primary color data) that have been converted and that have been output from the video signal conversion section 112 and outputs the sampled pixel data to the X driver circuit 117X. The digital signal processing section 113 may include a function of the sample-hold section 114.

The control section 115 is a control unit that controls the entire liquid crystal display apparatus 100. In addition, the control section 115 controls the video signal conversion section 112, the digital signal processing section 113, the sample-hold section 114, and so forth. Moreover, the control section 115 controls the X driver circuit 117X and the Y driver circuit 117Y at a predetermined timing corresponding to the foregoing RGB separate signals. The control section 115 may be composed of a processor, for example, a micro processing unit (MPU).

The video memory 116 temporarily stores (buffers) pixel data (primary color data) that are output from the sample-hold section 114 of the video signal processing circuit 110 and outputs the pixel data to the Y driver circuit 117Y at a predetermined timing.

The Y driver circuit 117Y supplies the video signal received from the video memory 116 to Y electrodes (signal wires) of the liquid crystal panel 118 at a predetermined timing controlled by the control section 115. In parallel with this operation, the X driver circuit 117X supplies a drive voltage to X electrodes (scanning lines) of the liquid crystal panel 118 at a predetermined timing controlled by the control section 115.

The RGB separate signals supplied from the video memory 116 to the Y driver circuit 117Y along with the video signal cause (drive) the liquid crystal panel 118 to display an image corresponding to the RGB separate signals.

Next, with reference to FIG. 7, an outline of the digital signal processing section 113 shown in FIG. 6 will be described.

Figure 7:
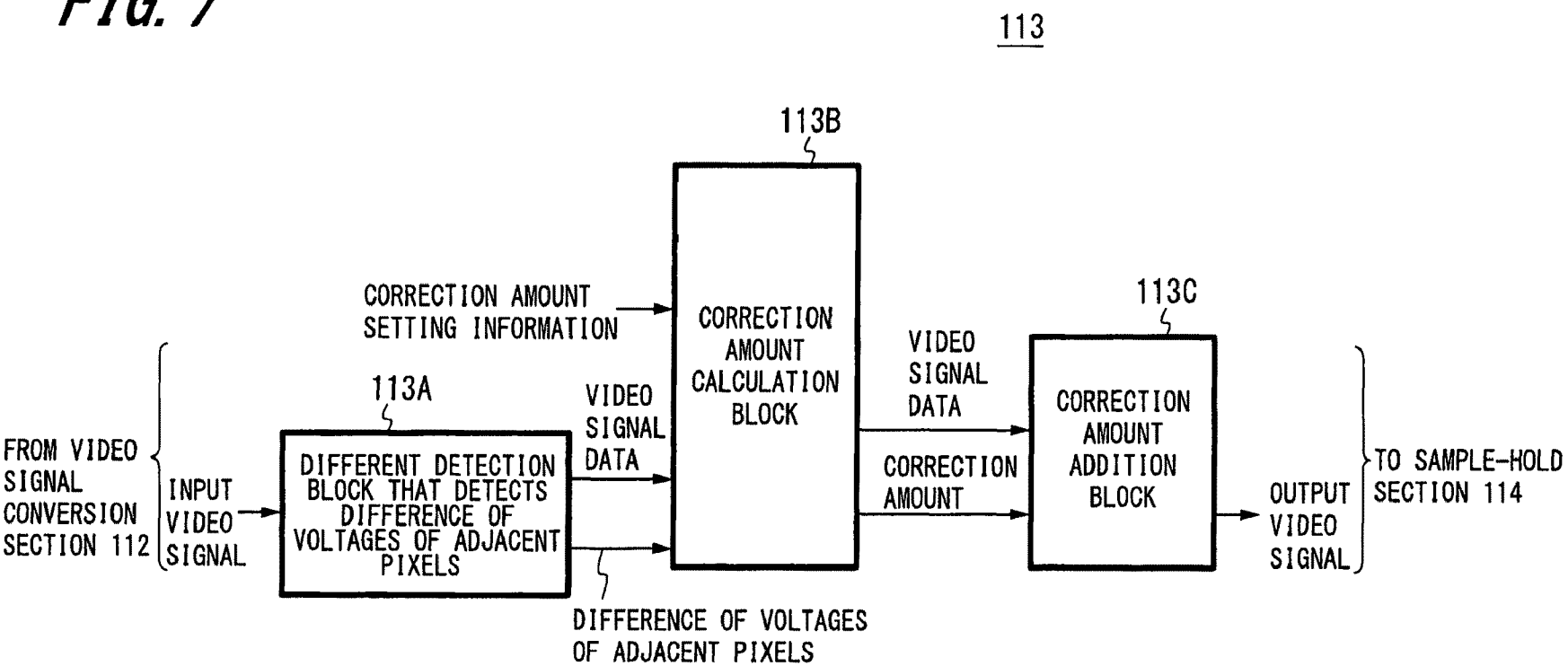
FIG. 7 is a block diagram showing an example of an outlined structure of a digital signal processing section shown in FIG. 6.

FIG. 7 is a block diagram showing an example of an outlined structure of the digital signal processing section 113 that performs a video signal correction process. The digital signal processing section 113 includes as processing blocks that perform the video signal correction process a difference detection block 113A that detects the difference of voltages of adjacent pixels (serving as a difference detection section), a correction amount calculation block 113B that calculates a correction amount (serving as a first calculation section), and a correction amount addition block 113C that adds a correction amount (serving as a correction amount addition section).

The difference detection block 113A is a device that detects the difference of a drive voltage of a pixel under consideration and a drive voltage of a pixel adjacent to the pixel under consideration, namely the difference of voltages of adjacent pixels, from the video signal that is input from the video signal conversion section 112.

The correction amount calculation block 113B is a device that obtains the difference of voltages of adjacent pixels calculated by the difference detection block 113A and video signal data (drive voltage information) for a pixel to be corrected (hereinafter referred to as a pixel under correction), refers to correction amount setting information based on the obtained information, and calculates a correction amount of a drive voltage applied to the pixel under correction.

The correction amount addition block 113C is a device that adds the correction amount calculated by the correction amount calculation block 113B to video signal data (drive voltage information) supplied to the pixel under correction and outputs the result as an output video signal to the sample-hold section 114.

Figure 8:
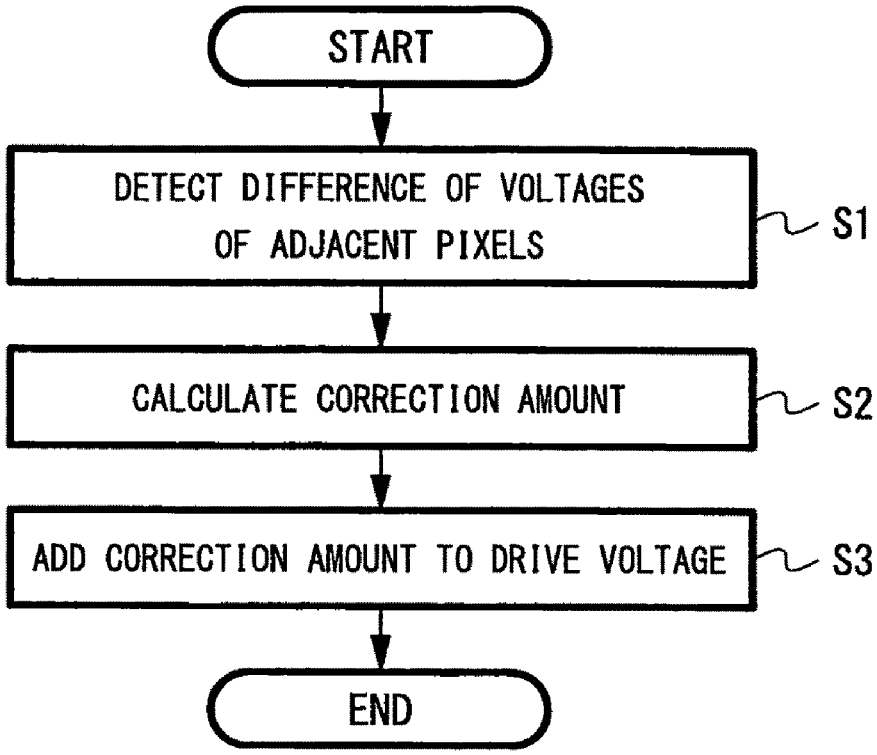
FIG. 8 is a flow chart showing a video signal processing method of a digital signal processing section.

FIG. 8 is a flow chart showing an example of a video signal process of the digital signal processing section 113. When a video signal is input to the difference detection block 113A, it detects the difference between a drive voltage of a pixel under consideration and a drive voltage of a pixel adjacent to the pixel under consideration from the input video signal (at step S1).

Thereafter, information about the difference of voltages of adjacent pixels detected at step S1 is input to the correction amount calculation block 113B and video signal data (drive voltage information) of the pixel under correction is input to the correction amount calculation block 113B. The correction amount calculation block 113B refers to correction amount setting information based on information about a difference of voltages of adjacent pixels and drive voltage information about the pixel under correction and obtains a correction amount for a drive voltage supplied to the pixel under correction (at step S2).

Last, the correction amount of the drive voltage of the pixel under correction and the drive voltage information about the pixel under correction calculated at step S2 are input to the correction amount addition block 113C. The correction amount addition block 113C adds the drive voltage and the correction amount and outputs the result as an output video signal (at step S3).

Next, with reference to FIG. 9, the digital signal processing section 113 (see FIG. 6) according to this embodiment of the present invention will be described.

Figure 9:
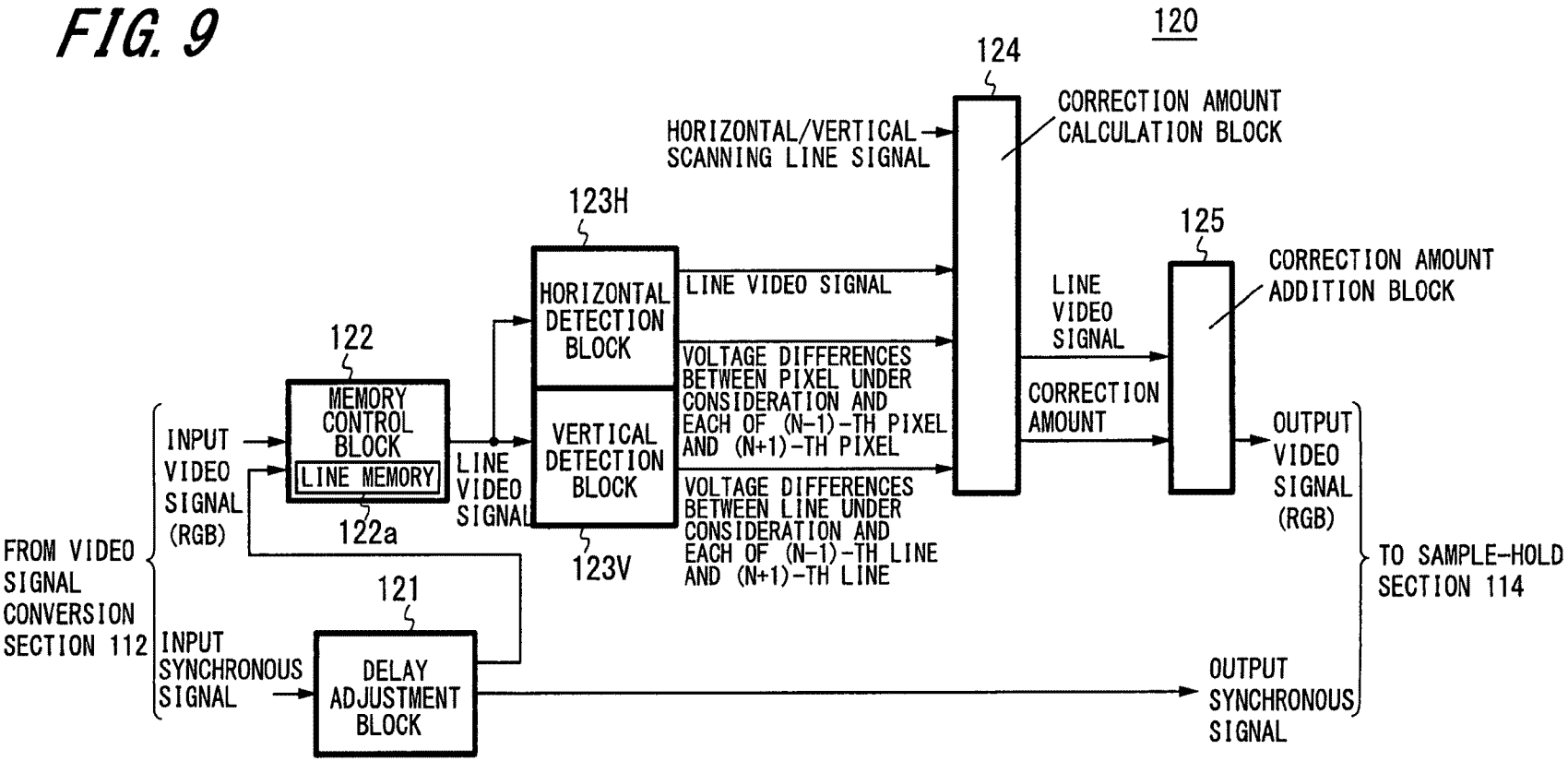
FIG. 9 is a block diagram showing an example of a detailed structure of principal portions of the digital signal processing section shown in FIG. 7.

FIG. 9 is a block diagram showing an example of a detailed structure of principal portions of the digital signal processing section 113. A digital signal processing section 120 is structured to control a delay of an input video signal so as to correct a drive voltage of a pixel not only in the horizontal scanning direction, but in the vertical scanning direction. In other words, the digital signal processing section 120 is structured to include a delay adjustment block 121, a memory control block 122, a horizontal detection block 123H (serving as a horizontal detection section) that detects the difference of voltages in the horizontal direction corresponding to the difference detection block 113A (see FIG. 7), a vertical detection block 123V (serving as a vertical detection section), a correction amount calculation block 124 (serving as a second calculation section), and a correction amount addition block 125 (serving as a correction amount addition section).

The digital signal processing section 120 is also provided with a synchronizing separation circuit (not shown) that separates a synchronous signal from the video signal. When the input video signal is a mono-chrome (white and black) video signal, after the synchronous signal is separated from the video signal, a luminance signal is obtained. On the other hand, when the input signal is a color video signal, after the synchronous signal is separated from the video signal, luminance information and color information are obtained. The color video signal is for example RGB signals.

The delay adjustment block 121 is a device that outputs a delay signal generated based on the synchronous signal separated from the original video signal to the memory control block 122 and outputs the input synchronous signal to the sample-hold section 114.

The memory control block 122 is a device that is provided with a line memory 122*a* and that delays the input video signal at intervals of a scanning line at a time (timing) based on the delay signal supplied from the delay adjustment block 121. The line memory 122*a* is composed, for example, of a random access memory (RAM). In the following description, the video signal that is delayed by the memory control block 122 at intervals of a scanning line is referred to as the line video signal.

The horizontal detection block 123H is a device that receives the line video signal and detects a voltage difference of a drive voltage supplied to a pixel under consideration and a drive voltage supplied to each of pixels adjacent thereto in the horizontal scanning direction. In other words, with respect to a process in the horizontal direction, when an N-th pixel (where N is any natural number) on a particular line is chronologically a pixel under consideration, the difference of a drive voltage supplied to the N-th pixel (pixel under consideration) and a drive voltage supplied to the (N−1)-th pixel on the same line, a voltage difference, is detected. Likewise, the difference of a drive voltage supplied to the N-th pixel (pixel under consideration) and a drive voltage supplied to the adjacent (N+1)-th pixel on the same line, a voltage difference, is detected. The obtained differences are output to the correction amount calculation block 124.

Likewise, the vertical detection block 123V is a device that receives a line video signal and detects a voltage difference of a pixel under consideration and each of pixels adjacent thereto in the vertical scanning direction. In other words, with respect to a process in the vertical direction, when a pixel on an N-th line (where N is any natural number) is chronologically a pixel under consideration, the difference between a drive voltage supplied to the pixel on the N-th line (pixel under consideration) and a drive voltage supplied to a pixel on the (N−1)-th line adjacent to the pixel on the N-th line, a voltage difference, is detected. Likewise, the difference between a drive voltage supplied to the pixel on the N-th line (pixel under consideration) and a drive voltage supplied to a pixel on the (N+1)-th line adjacent to the pixel on the N-th line, a voltage difference, is detected. The obtained voltage differences are output to the correction amount calculation block 124.

When one pixel of the display panel of the color display apparatus is composed of three color sub-pixels RGB, difference information for two systems of N-th pixel (pixel under consideration) and (N−1)-th pixel (line), and (N+1)-th pixel (line) is defected for each of the RGB sub-pixels each in the horizontal direction and the vertical direction.

The correction amount calculation block 124 is a device corresponding to the correction amount calculation block 113B (see FIG. 7) that will be described later. Next, the correction amount calculation block 124 will be described in brief. The voltage difference information detected by the horizontal detection block 123H and the vertical detection block 123V, a line video signal that is output from one of the voltage difference detection blocks, and a horizontal/vertical scanning line signal are input to the correction amount calculation block 124. The horizontal/vertical scanning line signal contains information that represents one of the vertical scanning direction and horizontal scanning direction. The correction amount calculation block 124 selects a pixel under correction based on these types of information, calculates a correction amount for a drive voltage supplied to the selected pixel under correction, and outputs the calculated correction amount to the correction amount addition block 125 along with the line video signal.

The correction amount addition block 125 is a device that corresponds to the correction amount addition correction amount addition block 113C (see FIG. 7) and that adds a correction amount extracted by the correction amount calculation block 124 to the line video signal and outputs the result as an output video signal to the sample-hold section 114.

In FIG. 9, the line video signal may be directly input to the correction amount calculation block 124 and the correction amount addition block 125.

Next, with reference to FIG. 10, the correction amount calculation block 124 outlined with reference to FIG. 9 will be described in detail.

Figure 10:
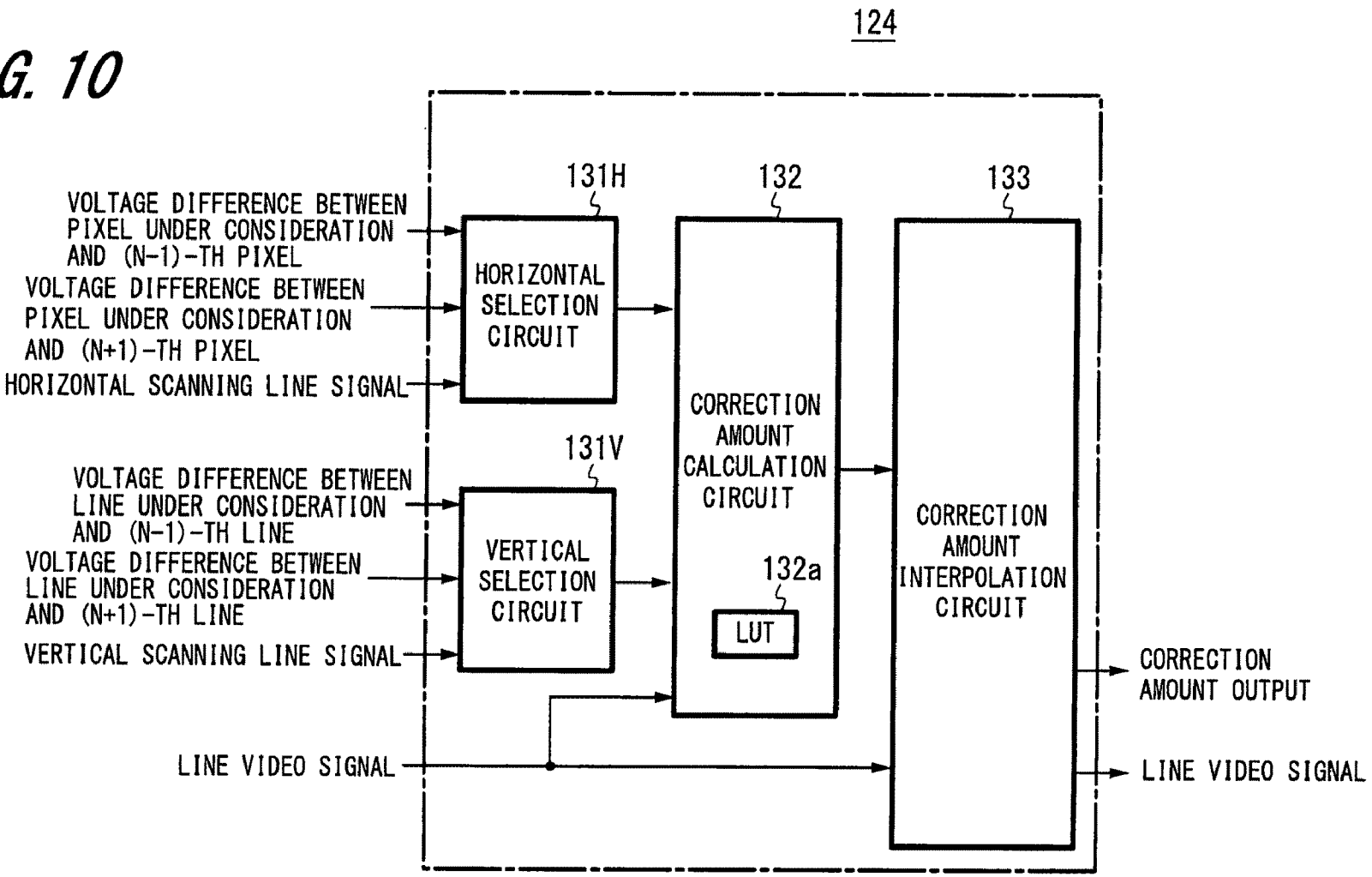
FIG. 10 is a block diagram showing an example of an internal structure of a correction amount calculation block shown in FIG. 8.

FIG. 10 is a block diagram showing an example of an internal structure of the correction amount calculation block 124. As shown in FIG. 10, the correction amount calculation block 124 is structured to include a horizontal selection circuit 131H (serving as a horizontal selection section), a vertical selection circuit 131V (serving as a vertical selection section), a correction amount calculation circuit 132, and a correction amount interpolation circuit 133.

The image quality defect phenomenon described in this embodiment of the present invention has a characteristic of which the direction of occurrence of an image quality defect does not change on the liquid crystal panel regardless of whether the video signal is inverted or not inverted (the scanning direction is inverted or not inverted). In other words, the direction in which the image quality defect phenomenon occurs is constant between pixels where a voltage difference occurs. Thus, regardless of the horizontal/vertical scanning directions, it is necessary to perform a process of correcting a drive voltage in the same direction. For example, when an image quality defect has occurred at a pixel on the left of a pixel having a black level in a right-evaporated liquid crystal display apparatus, if there is a voltage difference between a pixel having a black level at which the video signal is inverted and a pixel on the left of the pixel having the black level, an image quality defect occurs in the left-side pixel. For example, in a projector system, the video signal is inverted or not inverted depending on a projection method or the like. Thus, to correctly display an image, inversion and non-inversion of the video signal (scanning directions) are set. In this embodiment, a selection circuit that selects a signal from a plurality of voltage difference signals detected by the horizontal/vertical voltage difference detection blocks is provided.

The horizontal selection circuit 131H obtains voltage difference information about drive voltages supplied to a pixel under consideration and each of pixels adjacent to the pixel under consideration in the horizontal scanning direction from the horizontal detection block 123H and a horizontal scanning line signal from the control section 115. The voltage difference information about the pixel under consideration and pixels adjacent thereto in the horizontal scanning direction is a difference of drive voltages supplied to the N-th pixel (pixel under consideration) and the (N−1)-th pixel adjacent thereto on the same line and a difference of drive voltages supplied to the N-th pixel (pixel under consideration) and the (N+1)-th pixel adjacent thereto on the same line. On the other hand, the horizontal scanning line signal contains information about the horizontal scanning direction of the liquid crystal panel on which pixels are arranged in a matrix shape, namely information that represents whether the horizontal scanning direction is rightward or leftward. Instead, by analyzing the horizontal scanning line signal, information about the horizontal scanning direction may be obtained. The horizontal selection circuit 131H selects a pixel whose drive voltage is to be corrected (pixel under correction) based on the information about the horizontal voltage difference and the horizontal scanning line signal and supplies the selection information to the correction amount calculation circuit 132.

Likewise, the vertical selection circuit 131V obtains voltage difference information about drive voltages supplied to the pixel under consideration and each of pixels adjacent thereto in the vertical scanning direction from the vertical detection block 123V and obtains a vertical scanning line signal from the control section 115. The voltage difference information between the pixel under consideration and each of pixels adjacent thereto in the vertical scanning direction is a difference of drive voltages supplied to a pixel on the N-th line (pixel under consideration) and a pixel adjacent thereto on the (N−1)-th line and a difference of drive voltages supplied to the pixel on the N-th line (pixel under consideration) and a pixel adjacent thereto on the (N+1)-th line. On the other hand, the vertical scanning line signal contains information about the vertical scanning direction of the liquid crystal panel on which pixels are arranged in a matrix shape, namely, information that denotes whether the vertical scanning direction is downward or upward. Instead, by analyzing the vertical scanning line signal, information about the vertical scanning direction may be obtained. The vertical selection circuit 131V selects a pixel whose drive voltage is to be corrected (pixel under correction) based on the information about the vertical voltage difference and the vertical scanning line signal and supplies the selection information to the correction amount calculation circuit 132.

Figure 11:
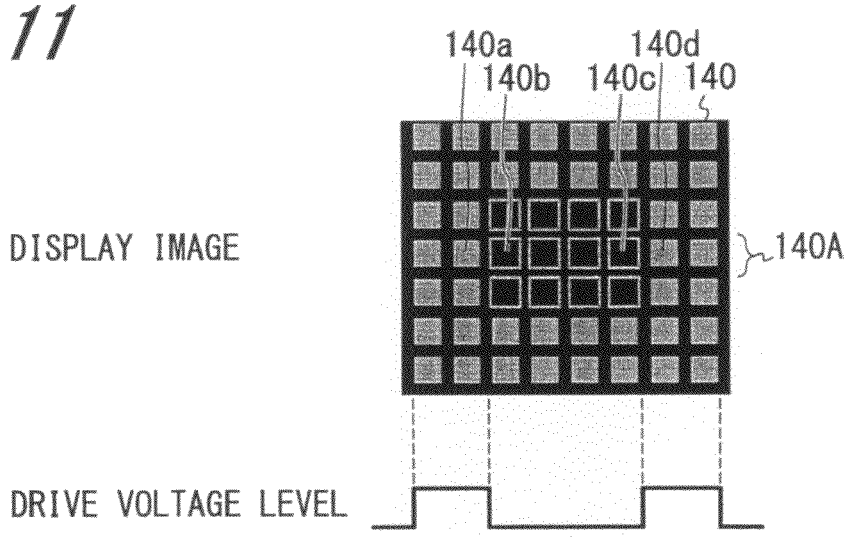
FIG. 11 is a schematic diagram showing an example of a display image based on an input video signal.
Figure 12A:
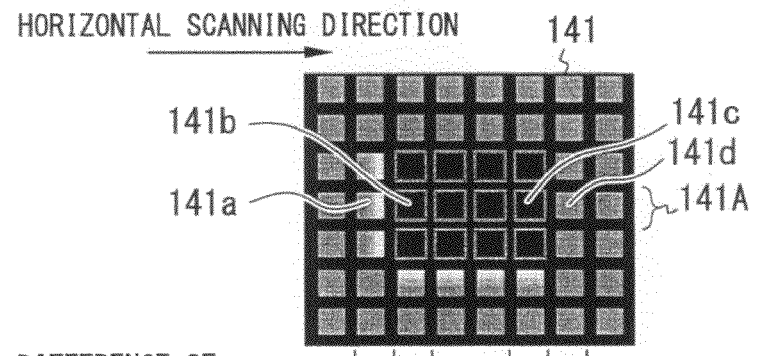
FIG. 12A, FIG. 12B, and FIG. 12C are schematic diagrams describing examples of setting of a correction position by selecting a voltage difference signal.
Figure 12B:
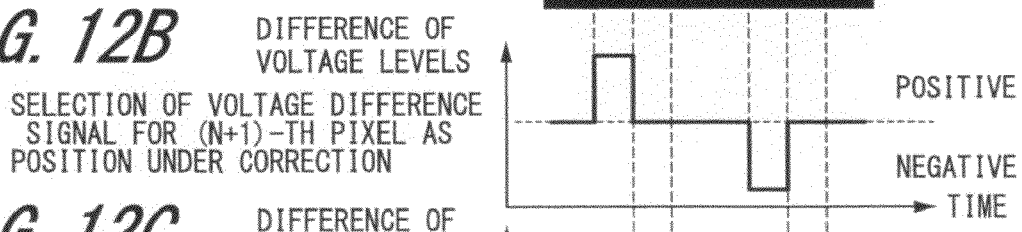
Figure 12C:
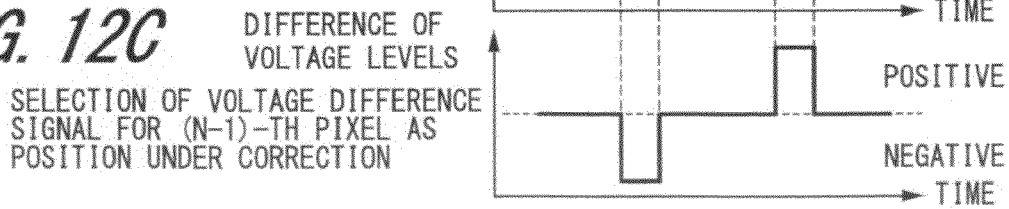

Next, a voltage difference signal (voltage difference information) that is input from a voltage difference detection block will be described with an example of the horizontal voltage difference. FIG. 11 is a schematic diagram showing a display image 140 corresponding to an input video signal and a drive voltage level of an image 140A on the center line thereof. FIG. 12A, FIG. 12B, and FIG. 12C are schematic diagrams describing detection of a position under correction/difference of signal levels when an image quality defect occurs in the display image 140 shown in FIG. 11.

In FIG. 11, the image 140A on the center line of the display image 140 is composed of eight pixels. In FIG. 11, four pixels at the center of the image 140A have a black level, whereas four pixels adjacent thereto have a gray level. A leftmost pixel 140*b* of the four pixels having the black level is adjacent to a pixel 140*a* having the gray level. A rightmost pixel 140*c* of the four pixels having the black level is adjacent to a pixel 140*d* having the gray level. In contrast, in an image 141A at the center line of a display image 141 where an image quality defect has occurred, a pixel 141*a* adjacent to a leftmost pixel 141*b* of four pixels having a black level has a white blurring pattern. In this situation, voltage difference signals shown in FIG. 12B and FIG. 12C are output from the horizontal detection block 123H based on the input video signal.

FIG. 12B shows a voltage difference signal that is a difference of voltages supplied to a pixel under consideration and an (N+1)-th pixel, namely the difference of voltage levels of which a drive voltage level of the pixel under consideration is subtracted from that of a pixel adjacent to the right of the pixel under consideration. In FIG. 12B, the voltage difference between the pixel 141*a* and the pixel 141*b* (the difference of black potential−gray potential) is positive and the voltage difference between a pixel 141*c* and a pixel 141*d* (difference of gray potential−black potential) is negative. On the other hand, FIG. 12C shows a voltage difference signal that is a voltage difference of the pixel under consideration and the (N−1)-th pixel, namely the difference of voltage levels of which a drive voltage level of a pixel adjacent to the right of the pixel under consideration is subtracted from the drive voltage level of the pixel under consideration. In FIG. 12C, the voltage difference of the pixel 141*a* and the pixel 141*b* (difference of gray potential−black potential) is negative, whereas the voltage difference of the pixel 141*c* and the pixel 141*d* (difference of black potential−gray potential) is positive. A candidate of a position under correction can be detected based on a waveform of the difference of voltage levels.

Thus, depending on the scanning direction, the waveform of the voltage difference signal of the voltage difference of the pixel under consideration and the (N+1)-th pixel is completely different from the waveform of the voltage difference signal of the voltage difference of the pixel under consideration and the (N−1)-th pixel. This situation also occurs in the vertical scanning direction. At this point, if a voltage difference occurs between two pixels, the horizontal selection circuit 131H and the vertical selection circuit 131V can select a chronologically earlier pixel or later pixel as a pixel under correction. The selection signal may be defined and designated by the user. Instead, since pixels where image quality defects occur change depending on the structure of the liquid crystal display apparatus 100, for example TN type or VA type, evaporation direction (pre-tilt orientation), and so forth, the horizontal/vertical selection circuits obtain information that represents the structure of the liquid crystal display apparatus, information that represents the evaporation direction, and so forth and affect them to the selection signal.

The correction amount calculation circuit 132 calculates a correction amount of a drive voltage for the pixel under correction based on the horizontal selection information received from the horizontal selection circuit 131H, the vertical selection information received from the vertical selection circuit 131V, and the line video signal received from the horizontal/vertical detection blocks.

The horizontal selection information supplied from the horizontal selection circuit 131H contains information about the voltage difference between the pixel under consideration and the (N−1)-th pixel on the same line or the voltage difference between the pixel under consideration and the (N+1)-th pixel on the same line according to the horizontal scanning line signal. Likewise, the vertical selection information supplied from the vertical selection circuit 131V contains information about the voltage difference between the pixel under consideration on the N-th line and a pixel adjacent thereto on the (N−1)-th line or the voltage difference between the pixel under consideration on the N-th line and a pixel adjacent thereto on the (N+1)-th line. On the other hand, the line video signal contains drive voltage information about individual pixels including the pixel under consideration and the pixel under correction.

The correction amount calculation circuit 132 calculates a correction amount of a drive voltage for the pixel under correction based on parameters of these horizontal selection information, vertical selection information, and information about a drive voltage for the pixel under correction contained in the line video signal. In addition, the correction amount calculation circuit 132 of this embodiment is provided with a two-dimensional or three-dimensional lookup table (hereinafter referred to as the "LUT") 132*a* based on the horizontal selection information, vertical selection information, and information about drive voltages.

The LUT 132*a* stores correction amounts of a drive voltage to be applied to the pixel under correction corresponding to a voltage level of an input video signal of a pixel under consideration and a voltage level that has been set to a pixel adjacent to the pixel under consideration, namely a difference of voltage levels of the pixel under consideration and a pixel adjacent thereto. Correction amounts are designated such that an average luminance of the pixel under correction whose drive voltage has been corrected becomes the same luminance as that of the pixel under correction to which the drive voltage that has not been corrected is applied corresponding to the input video signal. Thus, the display pattern of the display image that has not been corrected becomes the same as the display pattern of the display image that has been corrected.

The LUT 132*a* discretely sets points under correction that are decided based on the difference between a voltage level of an input video signal of a pixel under consideration and a voltage level of each of two pixels adjacent to the pixel under consideration. When the difference of voltage levels of a pixel under consideration and each of pixels adjacent thereto is small, since a lateral electric field that occurs therebetween is weak, an image quality defect hardly occurs. Thus, a threshold is designated for a difference between voltage levels of a pixel under consideration and each of pixels adjacent thereto. When the difference exceeds the designated threshold, a drive voltage for a pixel under correction is corrected. Thus, it is not necessary to correct drive voltages for all pixels that compose the liquid crystal panel 118. In addition, only a pixel expected to be corrected with a highly improvement effect against an image quality defect can be corrected. The user may be able to designate a correction amount of a drive voltage applied to a pixel under correction.

The LUT 132*a* has a plurality of tables corresponding to environmental information about the liquid crystal display apparatus 100, the environmental information being supplied from the control section 115. The environmental information about the liquid crystal display apparatus 100 includes horizontal/vertical scanning direction, pre-tilt orientation, distance (gap) between two adjacent pixels, and so forth. Thus, tables referred in the horizontal scanning direction for a pixel under consideration and a pixel adjacent to the left (right) of the pixel under consideration and tables referred in the vertical scanning direction for a pixel under consideration and a pixel adjacent to the above (below) of the pixel under consideration are prepared. In addition, tables referred when the pre-tilt orientation is left (right) of the front of the liquid crystal panel 118 are prepared. Moreover, since the intensity of the lateral electric field that occurs changes corresponding to the distance between two adjacent pixels, even if drive voltages applied to adjacent pixels are the same or voltage differences of two pixels are the same, taking into account of the gap between the two pixels, a setting value of the correction amount of the drive voltage for a pixel under correction is changed. The contents and correction amounts of the LUT 132*a* have been designated such that it can be used for various types of environmental information and their combinations.

The correction amount interpolation circuit 133 interpolates a correction amount that the correction amount calculation circuit 132 has calculated by referring to the LUT 132*a* and outputs the interpolated correction amount. For example, since points under correction have been discretely set in the LUT 132*a*, there may be no pixel under correction directly corresponding to a voltage level of an input video signal for a pixel under consideration. In this case, two pixels under correction most close to the voltage level of the input video signal is selected. Likewise, if there is no pixel under consideration most close to the difference of voltage levels of a pixel under consideration and a pixel adjacent thereto, two pixels under correction most close to the difference of voltage levels of two pixels is selected. An interpolation process such as a linear interpolation is performed for these four pixels under correction with respect to a correction amount and a processed result is output to the correction amount addition block 125.

In this embodiment, the correction amount calculation circuit 132 is provided with the LUT 132*a*. Instead, the correction amount calculation circuit 132 may have data of a curve of (selection information, drive voltage) vs. (correction amount). A correction amount of a drive voltage for a pixel under correction is uniquely decided based on the curve and information that is input to the correction amount calculation circuit 132. Instead, the user may define and designate a correction amount. Moreover, a correction amount may be designated using an external digital signal control section (not shown) in such a manner that the liquid crystal display apparatus 100 communicates with the digital signal control section through a serial interface and the designated contents are stored in a nonvolatile storage section such as a register. In such various modes, a compensation amount can be designated. When the LUT 132*a* is not used to calculate a correction amount, the correction amount interpolation circuit 133 can be omitted. In this case, a correction amount calculated in the correction amount calculation circuit 132 can be directly output to the correction amount addition block 125.

Next, an exemplary improvement of an image quality defect in a VA, right-evaporated liquid crystal display apparatus will be described.

Figure 4A:
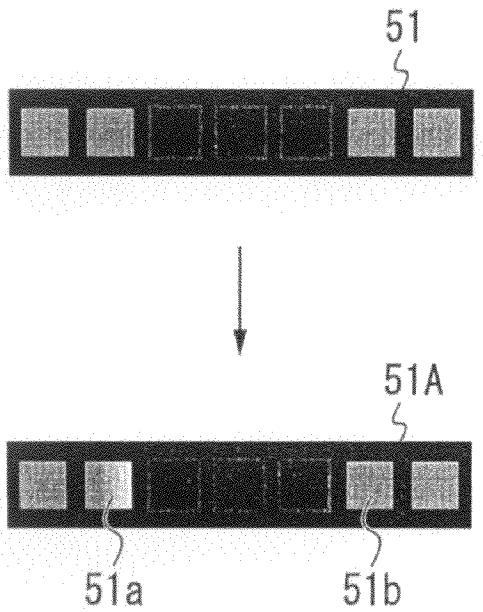
FIG. 4A, FIG. 4B, and FIG. 4C are schematic diagrams showing examples of an image quality defect phenomenon in a vertically aligned type (right-evaporated type) liquid crystal display apparatus.
Figure 4B:
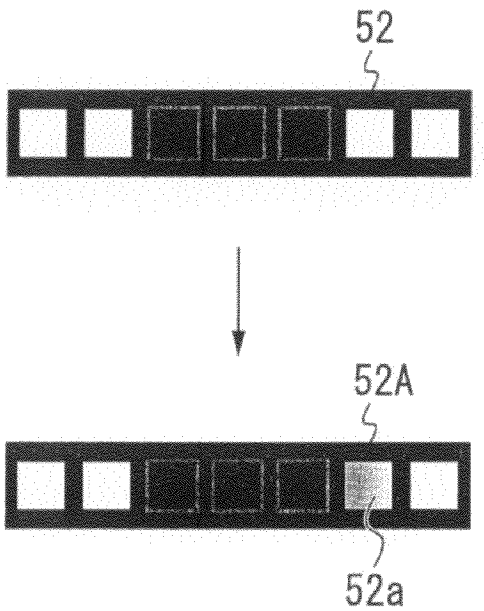
Figure 4C:
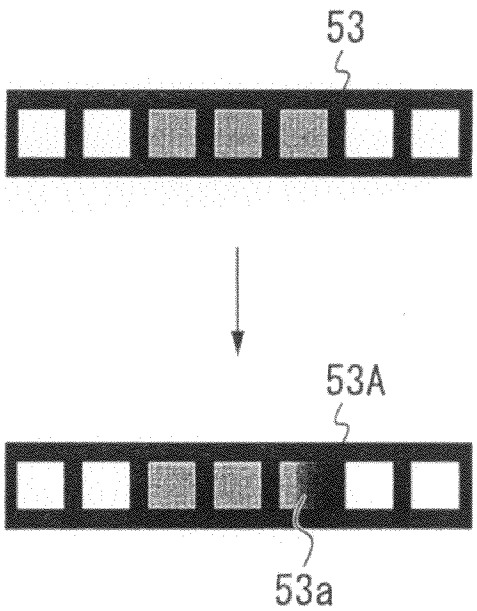
Figure 5A:
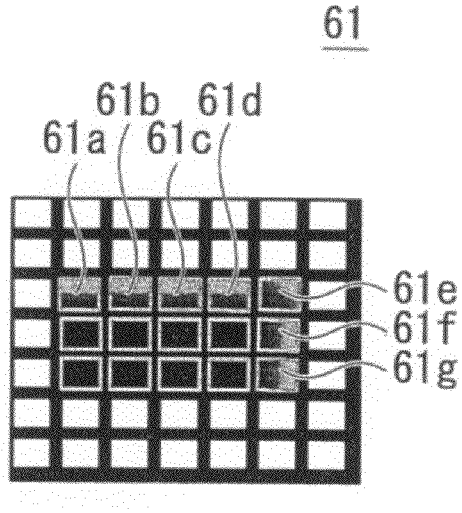
FIG. 5A and FIG. 5B are schematic diagrams showing examples of an image quality defect phenomenon in a TN type liquid crystal panel and a VA type liquid crystal panel.
Figure 5B:
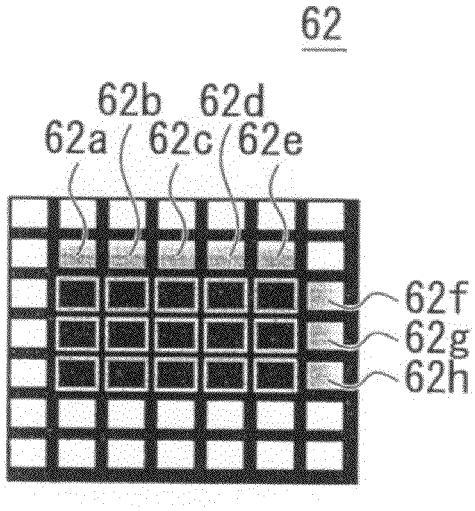
Figure 13A:
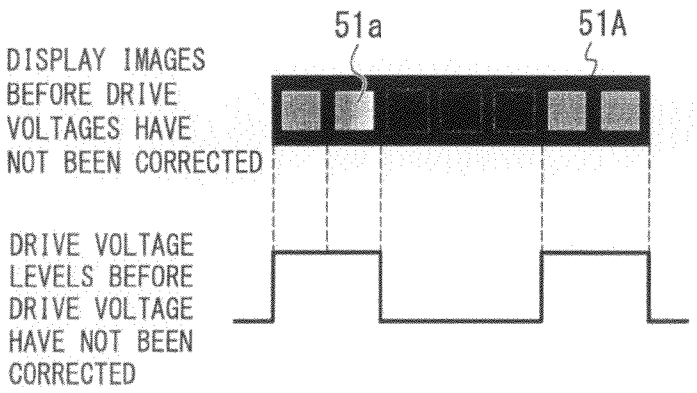
FIG. 13A, FIG. 13B, and FIG. 13C are schematic diagrams showing examples of display images and drive voltage levels upon occurrence of image quality defects.
Figure 13B:
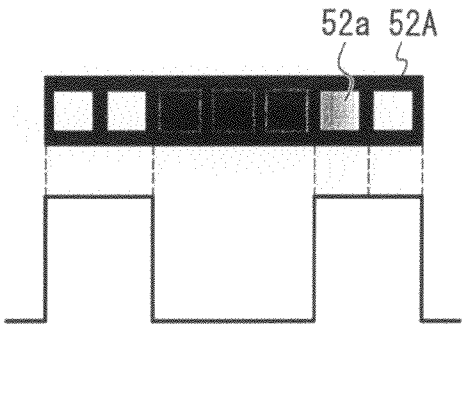
Figure 13C:
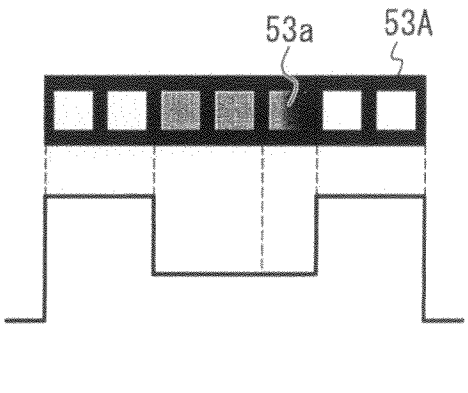
Figure 14A:
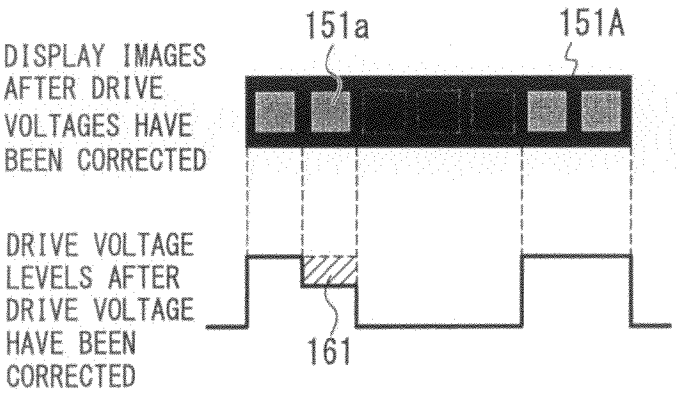
FIG. 14A, FIG. 14B, and FIG. 14C are schematic diagrams showing examples of display images and drive voltage levels after image quality defects have been corrected.
Figure 14B:
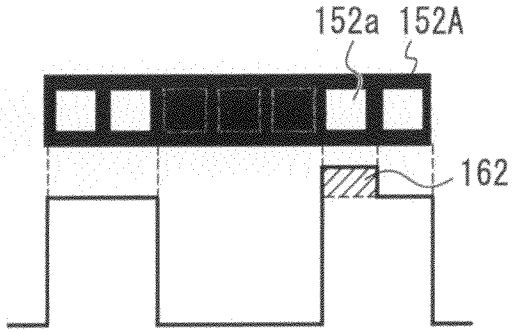
Figure 14C:
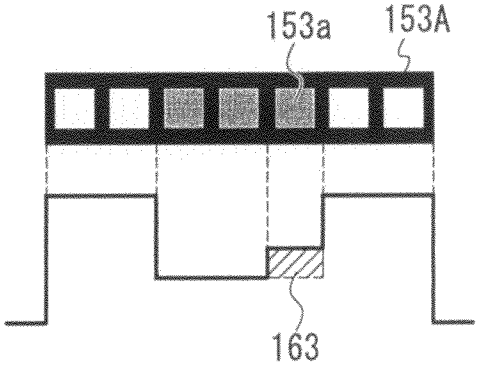

FIG. 13A, FIG. 13B, and FIG. 13C show examples of horizontal display images and drive voltage levels upon occurrence of image quality defects that are the same as those shown in FIG. 4A, FIG. 4B, and FIG. 4C, respectively. FIG. 14A, FIG. 14B, and FIG. 14C are schematic diagrams showing examples of display images and drive voltage levels where the display images shown in FIG. 13A, FIG. 13B, and FIG. 13C have been corrected.

In FIG. 13A, in a display image 51A of one line (seven pixels) whose image quality defect has not been corrected, a pixel 51*a* adjacent to the left of three pixels at the center portion has a white blurring display pattern. Normally, the pixel 51*a* has a gray level as its luminance. Thus, in this embodiment, the horizontal selection circuit 131H of the correction amount calculation block 124 (see FIG. 9 and FIG. 10) selects the pixel 51*a* as a position under correction based on a structural characteristic, pre-tilt orientation, and so forth of the liquid crystal display apparatus. The correction amount calculation circuit 132 refers to the LUT 132*a* with parameters of the foregoing types of information and adds a negative correction amount 161 to a drive voltage of the pixel 51*a* as the pixel under correction of the input video signal. As a result, the drive voltage level of the pixel 51*a* lowers and thereby a display image 151A containing a pixel 151*a* having a gray level free of white blurring is obtained.

In FIG. 13B, in a display image 52A of one line (seven pixels) whose image quality defect has not been corrected, a pixel 52*a* adjacent to the right of three pixels at the center has a black blurring display pattern. Normally, the pixel 52*a* has a white level as its luminance. Thus, in this embodiment, the horizontal selection circuit 131H of the correction amount calculation block 124 selects the pixel 52*a* as a position under correction based on such as structural characteristic, pre-tilt orientation, and so forth of the liquid crystal display apparatus. The correction amount calculation circuit 132 refers to the LUT 132*a* with parameters of the foregoing individual types of information and adds a positive correction amount 162 to the drive voltage of the pixel 52*a* as a pixel under correction of the input video signal. As a result, the drive voltage of the pixel 52*a* is raised and thereby a display image 152A containing a pixel 152*a* having a nearly white level free of black blurring can be obtained.

In FIG. 13C, in a display image 53A of one line (seven pixels) whose image quality defect has not been corrected, a pixel 53*a* at the right of three pixels at the center portion and adjacent to a pixel having a white level has a black blurring display pattern. Normally, the pixel 53*a* has a gray level as its luminance. Thus, in this embodiment, the horizontal selection circuit 131H of the correction amount calculation block 124 selects the pixel 53*a* as a position under correction based on such as structural characteristic, pre-tilt orientation, and so forth of the liquid crystal display apparatus. The correction amount calculation circuit 132 refers to the LUT 132*a* with parameters of the foregoing types of information and adds a positive correction amount 163 to the drive voltage of the pixel 53*a* as the pixel under correction of the input video signal. As a result, the drive voltage level of the pixel 53*a* is raised and thereby an image 153A containing a pixel 153*a* having a gray level free of black blurring can be obtained.

When the liquid crystal panel 118 is a color display, each pixel is composed, for example, RGB sub-pixels. In this case, taking into account of each of RGB sub-pixels and those adjacent thereto, a video signal is corrected. For example, in the horizontal direction, pairs of a B sub-pixel of an adjacent sub-pixel and an R sub-pixel of a sub-pixel under consideration; an R sub-pixel of the sub-pixel under consideration and a G sub-pixel of the sub-pixel under consideration; the G sub-pixel of the sub-pixel under consideration and a B sub-pixel of the sub-pixel under consideration; and the B sub-pixel of the sub-pixel under consideration and an R sub-pixel of another sub-pixel adjacent to the sub-pixel under consideration have relationship of adjacent positions. On the other hand, in the vertical direction, there are two adjacent lines that are an upper line and a lower line of a line under consideration.

As described above, the liquid crystal display apparatus according to the first embodiment detects a potential difference of an input video signal that is input to two adjacent pixels in the same frame period. When there is a potential difference in the input video signal that is input to the two adjacent pixels, the liquid crystal display apparatus selects a pixel under correction based on the potential difference of the two pixels, scanning direction, and evaporation direction (pre-tilt orientation) of the alignment film. Thereafter, the liquid crystal display apparatus refers to the LUT that correlates for example, correction amounts and potentials of input signals based on the potential difference of the two pixels and the potential of the input video signal corresponding to the pixel under correction and calculates a correction amount for a potential (drive voltage) of the pixel under correction of the input video signal. At this point, when taking into account of the distance of the two pixels, the liquid crystal display apparatus can obtain an appropriate correction amount. The liquid crystal display apparatus corrects a potential of the input video signal that is input to the pixel under correction, namely, the value of the drive voltage of the pixel under correction, with the calculated correction amount.

The two adjacent pixels are supposed to have the relationship of horizontal positions or vertical positions. Thus, the potential difference between two pixels is the potential difference between any pixel (pixel under consideration) and a pixel adjacent thereto (in the horizontal direction) or the potential difference between any pixel on any line (pixel under consideration) and a pixel on a line adjacent thereto (in the vertical direction).

Thus, in the matrix drive type liquid crystal panel, by appropriately correcting an input video signal for horizontally adjacent pixels or vertically adjacent pixels in the same frame period and decreasing the potential difference therebetween, a lateral electric field can be suppressed from occurring or can be weakened. As a result, since liquid crystal molecules can be suppressed from being improperly aligned, image quality defects due to fluctuation of transmittances of pixels can be improved.

In this embodiment, the video signal processing function (correction function) is applied to a direct-view-type liquid crystal display apparatus. Instead, the video signal processing function can be applied to a matrix-drive type display apparatus. For example, the video signal processing function can be implemented to a projector that uses a liquid crystal panel.

Figure 15:
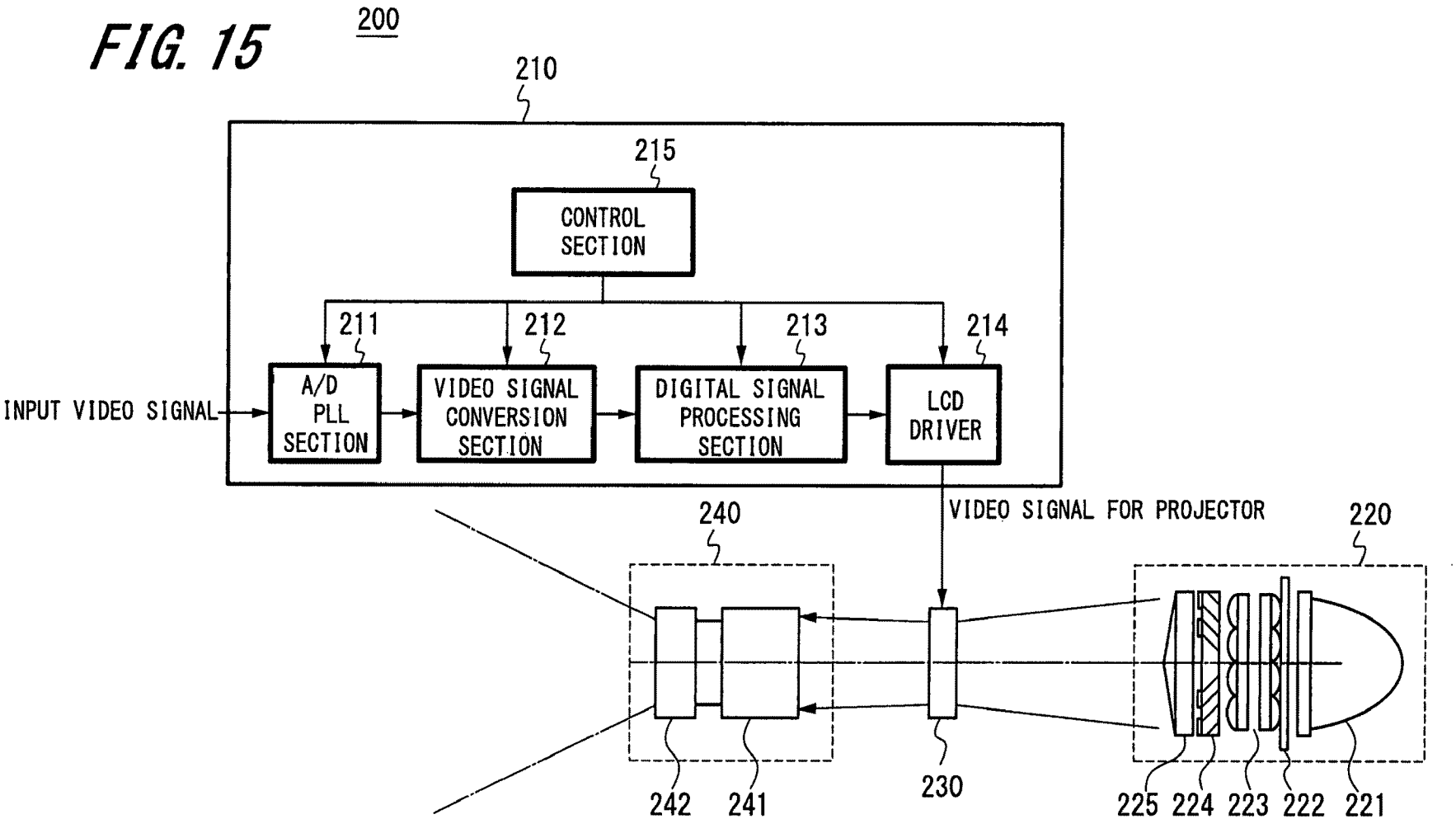
FIG. 15 is a block diagram showing an example of a structure of an entire projector according to a second embodiment of the present invention.
Figure 16:
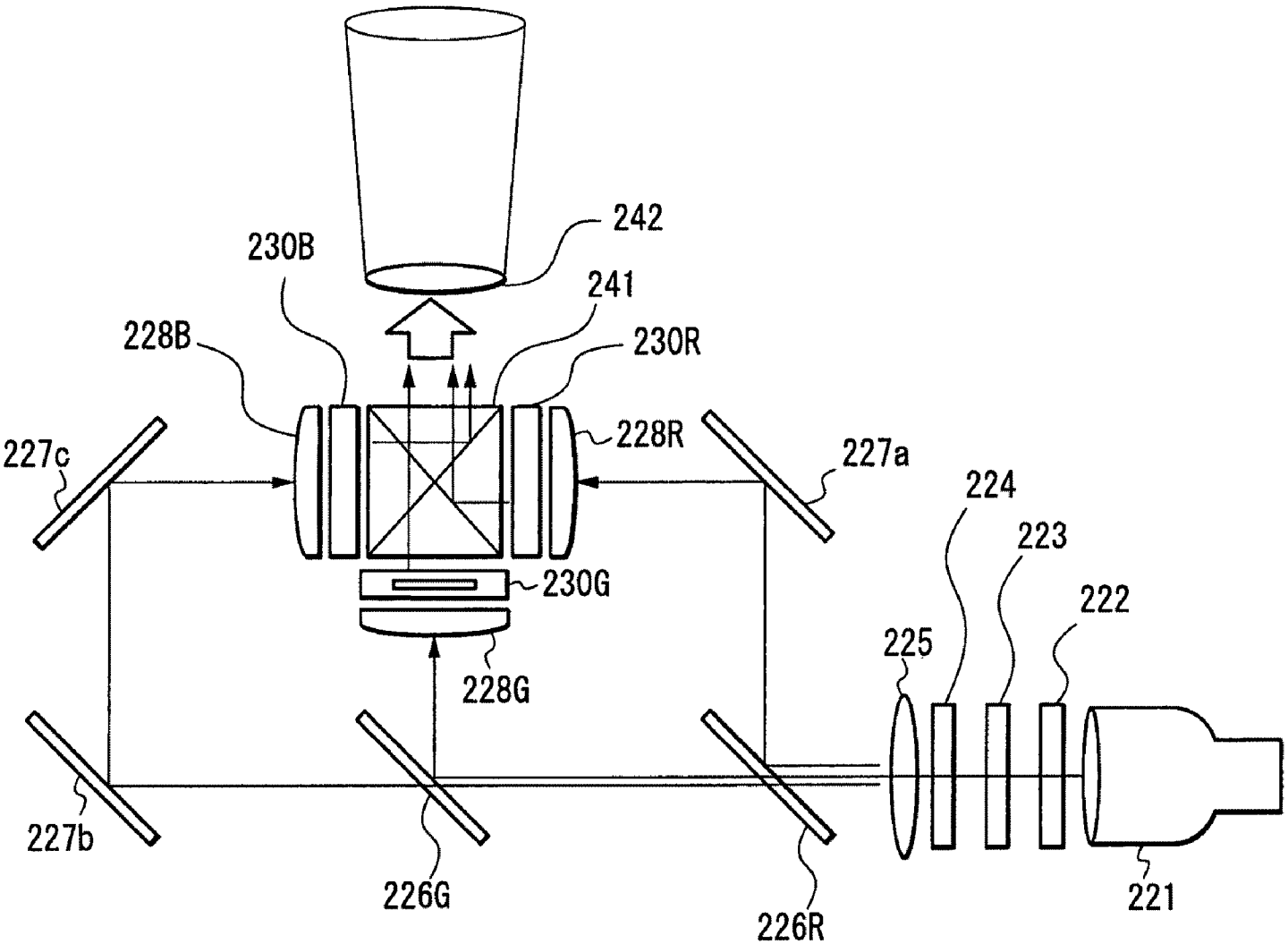
FIG. 16 is a schematic diagram showing an example of a structure of an optical system of the projector shown in FIG. 15.

Next, with reference to FIG. 15 and FIG. 16, a projector to which the video signal processing function (correction function) is applied will be described as a second embodiment of the present invention. FIG. 15 is a block diagram showing an example of an overall structure of the projector. FIG. 16 is a schematic diagram showing an example of a structure of an optical system of the projector shown in FIG. 15.

First, an example of the overall structure of the projector will be described.

As shown in FIG. 15, a projector 200 includes a video signal processing circuit 210, an illumination optical system 220, a liquid crystal panel 230, and a projection optical system 240.

The video signal processing circuit 210 has nearly the same structure and function as those of the video signal processing circuit 110 shown in FIG. 6. The video signal processing circuit 210 processes an input video signal to obtain a projector video signal suitable for a display on the liquid crystal panel 230. This video signal processing circuit 210 includes an A/D·PLL section 211, a video signal conversion section 212, a digital signal processing section 213, an LCD driver 214, and a control section 215.

The LCD driver 214 is provided with the functions of the X driver circuit 117X and the Y driver circuit 117Y shown in FIG. 6 and supplies a video signal, for example, to a three-plate type liquid crystal panel 230 at predetermined timing under the control of the control section 215. Instead, the functions of the sample-hold section 114 and the video memory 116 may be implemented to the LCD driver 214.

Since the A/D·PLL section 211, the video signal conversion section 212, the digital signal processing section 213, and the control section 215 have the same functions as those shown in FIG. 6, their detailed description will be omitted.

Next, an example of the structure of the optical system of the projector will be described.

As shown in FIG. 16, the optical system is provided with a light source 221 that includes, for example, a discharging lamp such as an ultra high pressure mercury lamp (UHP lamp) or a metal halide lamp and a reflector (parabolic mirror). Light emitted from the light source 221 is collimated by the reflector such that light becomes parallel beams of light nearly in parallel with an optical axis.

The beams of light emitted from the light source 221 enters a filter 222 that removes beams of light having unnecessary frequency components such as noise. Thereafter, the resultant beams of light transmit through a fry-eye lens (multi-lens array) 223 such that the beams of light are effectively and equally adjusted for an effective aperture of spatial light modulation devices (not shown) that will be described later.

The beams of light that have transmitted through the fry-eye lens 223 enter a PS separating/combining section 224. The PS separating/combining section 224 separates polarized components from the beams of light with high efficiency and polarizes the polarized components such that an optimum light amount can be secured. The resultant beams of light transmits through a lens 225 and enters a color separating/combining optical system downstream of a dichroic mirror 226R.

First, the dichroic mirror 226R reflects a red beam of light R, causes a green beam of light G and a blue beam of light B to pass. The optical path of the red beam of light R reflected by the dichroic mirror 226R is deflected by a mirror 227*a* by 90 degrees and directed to a red condenser lens 228R.

On the other hand, the green and blue beams of light G and B that have transmitted through the dichroic mirror 226R are separated by a dichroic mirror 226G. In other words, the dichroic mirror 226G reflects the green beam of light G, deflects the optical path of the green beam of light G by 90 degrees, and directs the green beam of light G to a green condenser lens 228G.

On the other hand, the red beam of light R transmits through the dichroic mirror 226G, straightly travels, and enters a blue-color condenser lens 228B through mirrors 227*b* and 227*c*.

The red, green, and blue beams of light R, G, and B transmit through the condenser lenses 228R, 228G, and 228B, respectively, and enter respective spatial light modulation devices.

Each of these spatial light modulation devices includes a liquid crystal panel and two polarizing plates. For example, the red spatial light modulation device includes a red liquid crystal panel 230R and an incident side polarizing panel (not shown) that is disposed upstream of the liquid crystal panel 230R and that polarizes incident light in a constant direction. In addition, a polarizing plate (not shown) is disposed downstream of the red liquid crystal panel 230R that causes only light components having a predetermined polarizing plane of exit light to pass such that the intensity of the transmitted light is modulated corresponding to a display image with a voltage supplied from the LCD driver 214 that drives liquid crystal. Likewise, the green spatial light modulation device includes a green liquid crystal panel 230G and two polarizing plates (not shown). The blue spatial light modulation device includes a blue liquid crystal panel 230B and two polarizing plates (not shown).

Beams of light of individual colors that have been light-modulated by the spatial light modulation devices enter a dichroic prism (light combining device) 241 from three directions. The dichroic prism 241 is composed of a four-divided cubic prism and reflection films (not shown) formed on the respectively divided surfaces.

The red beam of light R is reflected on the reflection film of the dichroic prism 241. The blue beam of light B is reflected on the reflection film and directed to a projection lens 242. The green beam of light G straightly travels toward the dichroic prism 241, transmits therethrough, and exits toward the projection lens 242. Thus, the red, green, and blue beams of lights R, G, and B are combined to one beam of light and exited toward the projection lens 241.

The projection lens 242 converts the beam of light entered from the dichroic prism 241 into projection light and projects the projection light to the front surface, for example, of a reflection type screen. Generally, since a front projection type display apparatus uses a liquid crystal panel as a light modulation device in a polarizing state, the apparatus projects projection light in a predetermined polarized state.

The liquid crystal panel 230 may be another type such as a reflection liquid crystal panel besides the transmission type liquid crystal panel shown in FIG. 15 and FIG. 16.

As described above, in the second embodiment, the digital signal processing section 213 selects a pixel under correction of each of color liquid crystal panels based on the potential difference of two pixels (including two sub-pixels) in the same frame period, scanning direction, and pre-tilt orientation. Thereafter, the digital signal processing section 213 refers to a LUT that stores correction amounts based on the potential difference of the two pixels and the potentials of the input video signal corresponding to the pixels and calculates a correction amount of a potential (drive voltage) of a pixel under correction corresponding to the input video signal. Thereafter, the digital signal processing section 213 corrects the potential of the video signal that is input to the pixel under correction, namely the value of the drive voltage for the pixel under correction, based on the calculated correction amount.

Thus, in the matrix drive type liquid crystal panel, by appropriately correcting an input video signal for horizontally adjacent pixels or vertically adjacent pixels in the same frame period and decreasing the potential difference therebetween, a lateral electric field can be suppressed from occurring or can be weakened. As a result, since liquid crystal molecules can be suppressed from being improperly aligned, image quality defects due to fluctuation of transmittances of pixels can be improved.

The projector shown in FIG. 15 and FIG. 16 is an example of the projection type display apparatus. Thus, the structure of the projection type display apparatus is not limited to that of the projector shown in FIG. 15 and FIG. 16.

In addition, the video signal processing function (correction function) can be also applied to a matrix drive type display apparatus using organic EL devices.

Next, a display apparatus using organic EL devices to which the video signal processing function (correction function) is applied will be described as a third embodiment of the present invention. An example of the organic EL display apparatus is disclosed in Japanese Unexamined Patent Application Publication No. 2007-123240, hereinafter referred to as Patent Document 2. As an example of the organic EL display apparatus according to the third embodiment of the present invention, the organic EL display apparatus disclosed in Patent Document 2 will be described in brief with reference to FIG. 17A and FIG. 17B.

Figure 17A:
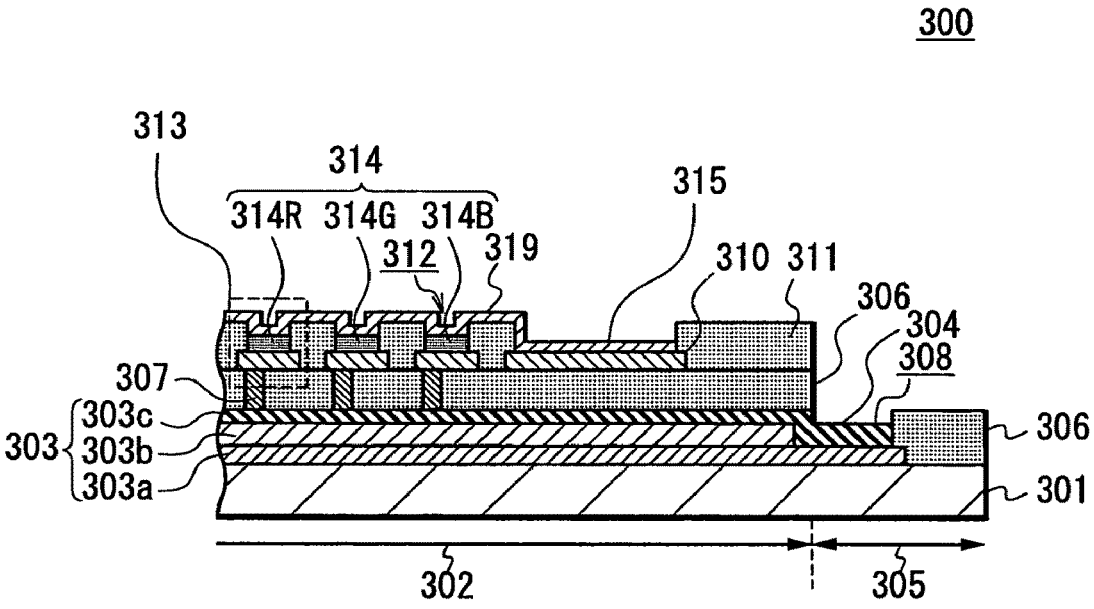
FIG. 17A and FIG. 17B are schematic diagrams showing an example of an outlined structure of an organic EL display apparatus according to a third embodiment of the present invention.
Figure 17B:
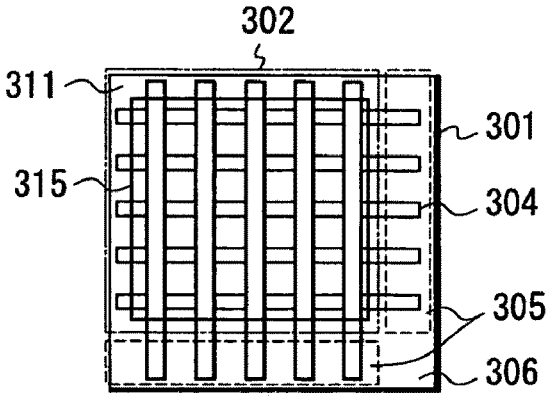

FIG. 17A and FIG. 17B show an example of an outlined structure of the organic EL apparatus disclosed in Patent Document 2, FIG. 17A is a sectional view, FIG. B is a plan view. An organic EL display apparatus 300 shown in FIG. 17 is an example of a top-emitting, active matrix type organic EL display apparatus.

As shown in FIG. 17A and FIG. 17B, a drive circuit 303 is formed on a display area 302 of a substrate 301 made of an insulation material such as glass. The drive circuit 303 is a circuit that drives an organic EL device (light emitting device) formed on the display area 302 at a later step. For example, the drive circuit 303 includes a TFT circuit 303*a* made, for example, of molybdenum (Mo) and a TFT circuit 303*c* made, for example, of aluminum (Al) and formed above the TFT circuit 303*a* through a TFT insulation film 303*b*. An external connection terminal 304 extends from the TFT circuit 303*a* and the TFT circuit 303*c* to an area outside the display area 302. Hereinafter, an area in which the external connection terminal 304 is formed outside the display area 302 is referred to as an external terminal area 305. In this embodiment, it is assumed that the external terminal area 305 is formed along two sides that compose one angle of four sides of the substrate 301 formed, for example, in a square shape.

A first insulation film 306 made, for example, of positive photosensitive poly-benzoxazole or the like is coated and formed on the drive circuit 303 formed on the substrate 301. The first insulation film 306 functions as a planarizing film that planarizes unevenness of the front surface of the substrate 301.

Contact holes 307 that connect the TFT circuit 303*c* and lower electrodes (positive) 319 (that will be described later) are formed in the first insulation film 306. In addition, an opening portion 308 is formed in the first insulation film 306 that coats the external connection terminal 304 and thereby the front surface of the external connection terminal 304 is exposed.

An electro-conductive layer (not shown) that is a laminate of a first ITO film, an Ag alloy film, and a second ITO film is formed on the first insulation film 306 such that the contact holes 307 are filled with this laminate on the substrate 301.

The lower electrodes 319 (anodes) corresponding to individual pixels are arrayed and formed on the first insulation film 306 of the display area 302 such that the lower electrodes 319 are connected to the TFT circuit 303*c* through the contact holes 307. In addition, auxiliary wirings 310 are formed on the first insulation film 306 at a circumferential portion of the display area 302. The auxiliary wirings 310 are formed in a picture-frame shape having a width of around 3 mm. In addition, the auxiliary wirings 310 are connected to a drive circuit (not shown).

A second insulation film 311 made, for example, of positive photosensitive poly-benzoxazole is coated and formed on the first insulation film 306 where the lower electrodes 319 and the auxiliary wirings 310 are formed. In addition, pixel openings 312 for individual pixels, namely organic EL devices, are formed in the display area 302. Thus, the front surface of the lower electrodes 319 is exposed. In addition, the front surface of the auxiliary wirings 310 is exposed. Moreover, organic layers 314 of individual color organic EL devices 313, namely a red organic layer 314R, a green organic layer 314G, and a blue organic layer 314B that have predetermined film thicknesses, are formed on the lower electrodes 319 in the pixel openings 312. For example, the red organic layer 314R has a film thickness of around 150 nm, the green organic layer 314G has a film thickness of around 100 nm, and the blue organic layer 314B has a film thickness of around 200 nm.

As described above, an electron injection layer (not shown) made, for example, of LiF and having a film thickness of around 1 nm is formed on the organic layers 314, the second insulation film 311, and the auxiliary wirings 310 on the substrate 301. An upper electrode 315 made, for example, of a semi-transmissive MaAg alloy is formed above the electron injection layer. The auxiliary wirings 310 and the upper electrode 315 are connected through the electron injection layer. In this embodiment, the lower electrodes 319 are anodes and the upper electrode 315 is a cathode. Instead, the lower electrodes 319 may be cathodes and the upper electrode 315 may be an anode.

As described above, in the organic EL display apparatus 300, organic EL devices 313 where the organic layers 314 are sandwiched by the lower electrodes 319 and the upper electrode 315 on the display area 302 of the substrate 301 are arrayed. The external connection terminal 304 extending from the drive circuit 303 is exposed in the external terminal area 305.

As described above, like the first and second embodiments, in the third embodiment, a pixel under correction of the organic EL devices 313 is selected based on a potential difference between two pixels (including two sub-pixels) in the same frame period and scanning direction. Thereafter, by referring to an LUT that stores, for example, correction amounts based on a potential difference between two pixels and potentials of an input video signal corresponding to the pixels, a correction amount of a potential (drive voltage) of the pixel under correction corresponding to the input video signal is calculated. For the organic EL device 313, the potential of the video signal that is input to the pixel under correction, namely the value of the drive voltage for the pixel under correction, is corrected based on the calculated correction amount.

Thus, in the matrix drive type organic EL display apparatus, by appropriately correcting an input video signal for horizontally adjacent pixels or vertically adjacent pixels in the same frame period, the potential difference between two pixels can be decreased. Thus, a lateral electric field can be suppressed from occurring or can be weakened. As a result, since the influence of the lateral electric field that occurs between two pixels can be prevented, image quality defects due to the lateral electric field can be improved.

In addition, the video signal processing function (correction function) can be applied to a plasma display apparatus.

Next, a plasma display apparatus to which the video signal processing function (correction function) is applied will be described as a fourth embodiment of the present invention. An example of the plasma display apparatus is disclosed, for example, as Japanese Unexamined Patent Application Publication No. 2007-73513, hereinafter referred to as Patent Document 3. As an example of the plasma display apparatus of the fourth embodiment of the present invention, the plasma display apparatus disclosed as Patent Document 3 will be described in brief with reference to FIG. 18 and FIG. 19A to FIG. 19C.

Figure 18:
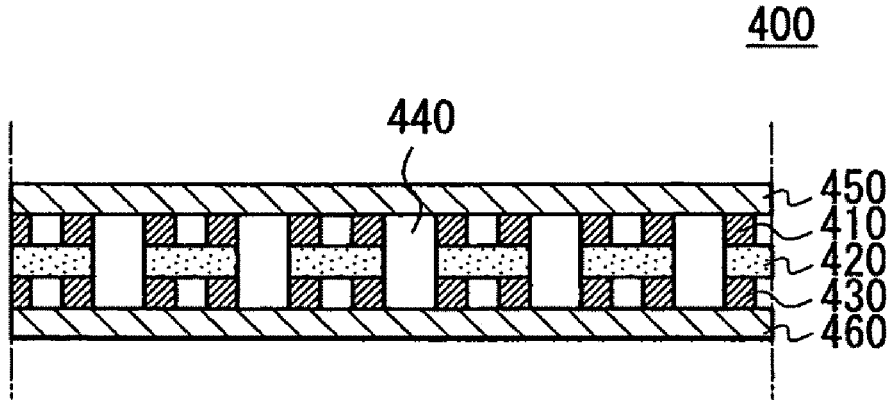
FIG. 18 is a sectional view showing a structure of principal portions of a plasma display apparatus according to a fourth embodiment of the present invention.
Figure 19A:
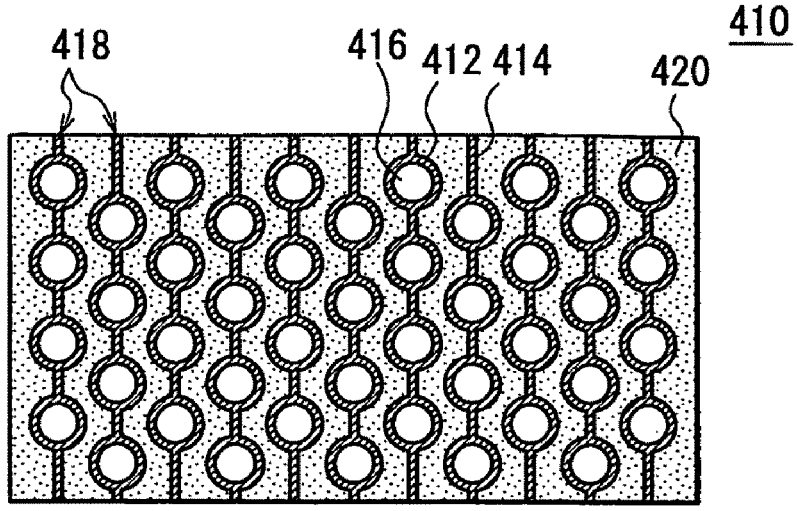
FIG. 19A, FIG. 19B, and FIG. 19C are plan views showing an upper electrode layer, a lower electrode layer, and a dielectric layer, respectively, of the plasma display apparatus shown in FIG. 17.
Figure 19B:
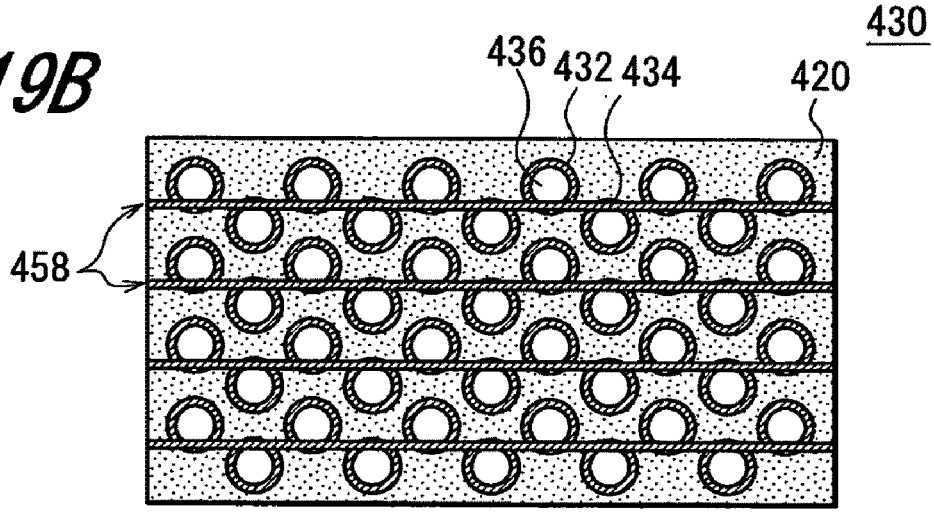
Figure 19C:
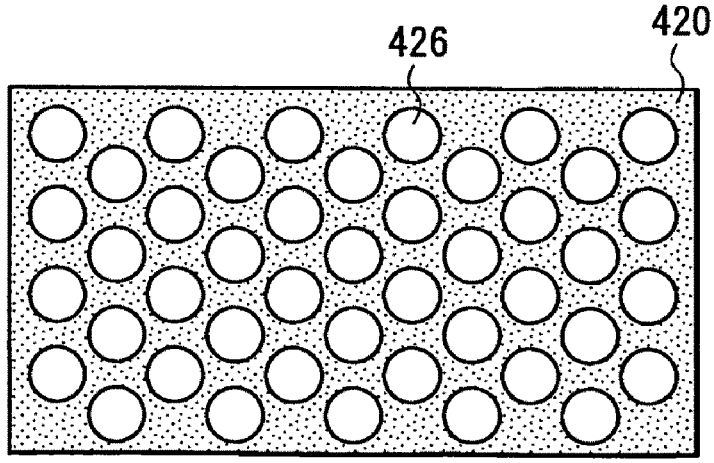

FIG. 18 is a principal sectional view showing a structure of the plasma display apparatus. FIG. 19A, FIG. 19B, and FIG. 19C are principal plan views showing the plasma display apparatus shown in FIG. 18, FIG. 19A shows an upper electrode layer, FIG. 19B shows a lower electrode layer, and FIG. 19C shows a dielectric layer.

In the plasma display apparatus 400 shown in FIG. 18, FIG. 19A, FIG. 19B, and FIG. 19C, electrode portions except for circumferences of through-holes 416 and 436 are removed to decrease a parasitic capacitance of a micro-discharging structure. In addition, to form connection members 414 and 434 that apply a voltage to discrete electrodes 412 and 432 around a through-hole 440, a structure of a matrix type plasma display apparatus is used.

As shown in FIG. 19A, the connection members 414 of the upper electrode 410 are formed in the vertical direction or the horizontal direction of an upper electrode layer 410 such that a group of first electrodes 418 is provided. As shown in FIG. 19B, the connection members 434 of a lower electrode layer 430 are formed nearly perpendicularly to the first electrodes 418 such that a group of second electrodes 458 is provided. To arrange the through-holes 426 of a dielectric layer 420 in a delta shape, as shown in FIG. 19B, the second electrodes 458 are composed of horizontally formed linear connection members 434 and discrete electrodes 432 each of which surrounds through-holes arranged in a zigzag shape above and below the connection members 434. Totally, the second electrodes 458 are formed in the horizontal direction. The through-holes 436 of the electrode layer 430 contained in the second electrodes 458 are considered to be contained in the group of through-holes 436 arranged in the horizontal direction of the lower electrode layer 430.

In addition, the first electrodes 418 are connected to each terminal of an address driver as address electrodes and the second electrodes 458 are connected to each terminal of a scan driver as scan electrodes. In this case, a negative voltage is applied to the uppermost scan electrodes of FIG. 19B. A positive voltage is applied to a first address electrode and a third address electrode as the leftmost electrode and the third leftmost electrode of FIG. 19A. When a potential difference causing discharging occurs between electrodes, discharging occurs between the first and second through-holes of the first line.

When a voltage is applied successively to the second and third scan electrodes and a voltage is applied to address electrodes corresponding to an image to be displayed, discharging occurs at the corresponding through-holes. In such a system, when the overall through-holes are scanned, an image is displayed due to a residual image effect caused by presence/absence of discharging of each through-hole.

Substrates 410 and 430 disposed outside the upper and lower electrodes 410 and 430 shown in FIG. 18 are used to seal the interior. Circumferential portions of these substrates 410 and 430 are sealed. After the interior that forms a discharge space except for exhaust openings (not shown) is sealed, air is exhausted therefrom. Instead, the discharge space is filled with discharge gas at a proper pressure. Thereafter, the exhaust opening is sealed. In this manner, the discharge gas is used to prevent electrodes from contacting oxygen of air and being oxidized and deteriorated when a voltage is applied and to suppress them from being evaporated and increase the discharging efficiency.

As described above, like the first, second, and third embodiments, in the fourth embodiment, a pixel under correction is selected in the plasma display apparatus 400 based on a potential difference of two pixels (including two subpixels) in the same frame period and a scanning direction. Thereafter, an LUT that stores correction amounts is referred based on the potential difference between two pixels and potentials of individual pixels corresponding to an input video signal, and then a correction amount of a potential (drive voltage) of a pixel under correction corresponding to the input video signal is calculated. A potential of a video signal that is input to the pixel under correction, namely a value of a drive voltage of the pixel under correction, is corrected based on the calculated correction amount.

Thus, in the matrix drive type plasma display apparatus, an input video signal that is input to horizontally/vertically adjacent pixels is adequately corrected in the same frame period such that a potential difference between two pixels can be decreased. Thus, a lateral electric field can be suppressed from occurring or being weakened. As a result, since the influence of the lateral electric field that occurs between two pixels can be eliminated, image quality defects due to the lateral electric field can be improved.

The present application contains subject matter related to that disclosed in Japanese Priority Patent Application JP 2008-084812 filed in the Japanese Patent Office on Mar. 27, 2008, the entire content of which is hereby incorporated by reference.

It should be understood by those skilled in the art that various modifications, combinations, sub-combinations and alternations may occur depending on design requirements and other factors insofar as they are within the scope of the appended claims or the equivalents thereof.

What is claimed is:

1. A video signal processing circuit, comprising:

a difference detection section configured to detect a difference between a drive voltage for each of pixels of a matrix drive type display panel as a pixel under consideration and a drive voltage of each of pixels adjacent to the pixel under consideration from an input video signal, wherein the pixels adjacent to the pixel under consideration include pixels horizontally adjacent and vertically adjacent to the pixel under consideration;

a first calculation section configured to calculate a correction amount of a drive voltage for a pixel under correction that has a luminance change due to an electric field caused by a difference of the drive voltages for the two pixels detected by the difference detection section; and a correction amount addition section configured to correct a value of the drive voltage for a pixel under correction that has the luminance change based on the correction amount calculated by the first calculation section.

2. The video signal processing circuit as set forth in claim 1, wherein the difference detection section includes:

a horizontal detection section that detects a difference of the drive voltage of the pixel under consideration and the drive voltage of each of pixels horizontally adjacent to the pixel under consideration; and a vertical detection section that detects a difference of the drive voltage of the pixel under consideration and the drive voltage of each of pixels vertically adjacent to the pixel under consideration.

3. The video signal processing circuit as set forth in claim 1, further comprising:

a line memory configured to store a frame image contained in the input image signal at intervals of a scanning line based on a delay signal; and a memory control section configured to output the frame image from the line memory to the difference detection section at the intervals of the scanning line.

4. A video signal processing circuit, comprising:

a difference detection section configured to detect a difference between a drive voltage for each of pixels of a matrix drive type display panel as a pixel under consideration and a drive voltage of each of pixels adjacent to the pixel under consideration from an input video signal;

a first calculation section configured to calculate a correction amount of a drive voltage for a pixel under correction that has a luminance change due to an electric field caused by a difference of the drive voltages for the two pixels detected by the difference detection section; and a correction amount addition section configured to correct a value of the drive voltage for a pixel under correction that has the luminance change based on the correction amount calculated by the first calculation section;

wherein the difference detection section includes:

a horizontal detection section that detects a difference of the drive voltage of the pixel under consideration and the drive voltage of each of pixels horizontally adjacent to the pixel under consideration; and a vertical detection section that detects a difference of the drive voltage of the pixel under consideration and the drive voltage of each of pixels vertically adjacent to the pixel under consideration; and wherein the first calculation section includes:

a horizontal selection section that selects the pixel under correction based on the difference of the drive voltage of the pixel under consideration and the drive voltage of each of pixels horizontally adjacent to the pixel under consideration and a horizontal scanning line signal;

a vertical direction selection section that selects the pixel under correction based on the difference of the drive voltage of the pixel under consideration and the drive voltage of each of pixels vertically adjacent to the pixel under consideration and a vertical scanning line signal; and a second calculation section that decides a correction amount of a drive voltage for the pixel under correction selected by the horizontal selection section and the vertical selection section such that the correction amount of the drive voltage causes an average luminance for the pixel under correction after corrected to be identical to a luminance of a drive voltage based on the input video signal.

5. The video signal processing circuit as set forth in claim 4, wherein the second calculation section decides a correction amount of a drive voltage for the pixel under correction at least when a difference between a drive voltage of the pixel under consideration and a drive voltage of each of the pixels adjacent to the pixel under consideration is equal to or larger than a predetermined threshold.

6. The video signal processing circuit as set forth in claim 4, wherein the pixel under correction that has a luminance change due to an electric field caused by the difference of the drive voltages for the two pixels is decided by a pre-tilt angle of liquid crystal molecules of the display panel.

7. The video signal processing circuit as set forth in claim 4, wherein the pixel under correction that has a luminance change due to an electric field caused by the difference of the drive voltages for the two pixels is decided by a pre-tilt angle of liquid crystal molecules of the display panel, a difference value of the drive voltages of the two adjacent pixels, and a distance of the electrodes.

8. The video signal processing circuit as set forth in claim 4, wherein the horizontal selection section and the vertical selection section determine a scanning direction based on the horizontal scanning line signal and the vertical scanning line signal and select a pixel that is adjacent to the pixel under consideration and whose drive voltage is different from a drive voltage of the pixel under consideration in the determined scanning direction as a pixel under correction.

9. The video signal processing circuit as set forth in claim 4, further comprising:

a correction amount interpolation section configured to perform an interpolation process based on a plurality of candidates and calculate a correction amount of a drive voltage of the pixel under correction when the second calculation section has calculated a plurality of correction amounts.

10. A display apparatus, comprising:

a matrix drive type display panel;

a video signal processing circuit including:

a difference detection section that detects a difference between a drive voltage for each of pixels of the matrix drive type display panel as a pixel under consideration and a drive voltage of each of pixels adjacent to the pixel under consideration from an input video signal, wherein the pixels adjacent to the pixel under consideration include pixels horizontally adjacent and vertically adjacent to the pixel under consideration, a first calculation section that calculates a correction amount of a drive voltage for a pixel under correction that has a luminance change due to an electric field caused by a difference of the drive voltages for the two pixels detected by the difference detection section, and a correction amount addition section that corrects a value of the drive voltage for a pixel under correction that has the luminance change based on the correction amount calculated by the first calculation section; and a drive circuit configured to supply a drive voltage output from the correction amount addition section to each pixel of the display panel.

11. A display apparatus, comprising:

a matrix drive type display panel;

a video signal processing circuit including:

a difference detection section that detects a difference between a drive voltage for each of pixels of the matrix drive type display panel as a pixel under consideration and a drive voltage of each of pixels adjacent to the pixel under consideration from an input video signal, wherein the pixels adjacent to the pixel under consideration include pixels horizontally adjacent and vertically adjacent to the pixel under consideration, a first calculation section that calculates a correction amount of a drive voltage for a pixel under correction that has a pixel transmittance change due to an electric field caused by a difference of the drive voltages for the two pixels detected by the difference detection section, and a correction amount addition section that corrects a value of the drive voltage for a pixel under correction that has the pixel transmittance change based on the correction amount calculated by the first calculation section; and a drive circuit configured to supply a drive voltage output from the correction amount addition section to each pixel of the display panel.

12. A projection type display apparatus, comprising:

a light source;

a matrix drive type liquid crystal panel configured to be irradiated with illumination light from the light source through an illumination optical system;

a projection optical system configured to project light that passes through the liquid crystal panel;

a video signal processing circuit including:

a difference detection section that detect a difference between a drive voltage for each of pixels of the matrix drive type display panel as a pixel under consideration and a drive voltage of each of pixels adjacent to the pixel under consideration from an input video signal, wherein the pixels adjacent to the pixel under consideration include pixels horizontally adjacent and vertically adjacent to the pixel under consideration, a first calculation section that calculates a correction amount of a drive voltage for a pixel under correction that has a luminance change due to an electric field caused by a difference of the drive voltages for the two pixels detected by the difference detection section, and a correction amount addition section that corrects a value of the drive voltage for a pixel under correction that has the luminance change based on the correction amount calculated by the first calculation section; and a drive circuit configured to supply the drive voltage that is output from the correction amount addition section to each pixel of the liquid crystal panel.

13. A video signal processing method, comprising the steps of:

detecting a difference between a drive voltage for each of pixels of a matrix drive type display panel as a pixel under consideration and a drive voltage of each of pixels adjacent to the pixel under consideration from an input video signal;

for a given pixel under consideration, selecting from among the adjacent pixels a correction pixel based on the detected difference between the drive voltages of the correction pixel and the given pixel under consideration, wherein the correction pixel has a luminance change due to an electric field caused by a difference between the drive voltages of the correction pixel and the given pixel under consideration;

calculating a correction amount of a drive voltage for the correction pixel; and correcting a value of the drive voltage for the correction pixel based on the correction amount that has been calculated.